US008955212B2

(12) United States Patent
Mao et al.

(10) Patent No.: US 8,955,212 B2
(45) Date of Patent: Feb. 17, 2015

(54) METHOD FOR MANUFACTURING A MICRO-ELECTRO-MECHANICAL MICROPHONE

(75) Inventors: Jianhong Mao, Shanghai (CN); Deming Tang, Shanghai (CN)

(73) Assignee: Lexvu Opto Microelectronics Technology (Shanghai) Ltd, Shanghai (CN)

( * ) Notice: Subject to any disclaimer, the term of this patent is extended or adjusted under 35 U.S.C. 154(b) by 0 days.

(21) Appl. No.: 13/810,698

(22) PCT Filed: Jan. 26, 2011

(86) PCT No.: PCT/CN2011/070649
§ 371 (c)(1),
(2), (4) Date: Jan. 17, 2013

(87) PCT Pub. No.: WO2012/013027

PCT Pub. Date: Feb. 2, 2012

(65) Prior Publication Data

US 2013/0129118 A1 May 23, 2013

(30) Foreign Application Priority Data

Jul. 30, 2010 (CN) ..... 2010 1 0244213

(51) Int. Cl.
*H01F 3/04* (2006.01)
*H01F 7/06* (2006.01)
(Continued)

(52) U.S. Cl.
CPC ..... *H04R 9/08* (2013.01); *H04R 19/005* (2013.01); *H04R 19/04* (2013.01); *H04R 31/00* (2013.01)
USPC ..... 29/609.1; 29/592.1; 29/594; 29/595; 257/E21.449; 257/E21.509; 257/E23.061; 257/E29.324; 381/174; 438/48; 438/51; 438/53; 438/462

(58) Field of Classification Search
USPC ..... 29/592.1, 594, 595, 609.1; 257/419, 257/690, E21.449, E21.509, E23.061, 257/E29.324; 381/174; 438/48, 51, 53, 462
See application file for complete search history.

(56) References Cited

U.S. PATENT DOCUMENTS 5,414,917 A * 5/1995 Tanaka ..... 29/25.35
7,753,495 B2 * 7/2010 Hayakawa et al. ..... 347/64
(Continued)

FOREIGN PATENT DOCUMENTS

CN 101094540 A 12/2007
CN 101422053 A 4/2009
(Continued)

OTHER PUBLICATIONS

International Search Report (in Chinese with English translation) and Written Opinion (in Chinese) for PCT/CN2011/070649, mailed May 5, 2011; ISA/CN.

*Primary Examiner* — Paul D Kim
(74) *Attorney, Agent, or Firm* — Harness, Dickey & Pierce, P.L.C.

(57) ABSTRACT

A micro-electro-mechanical microphone and manufacturing method thereof are provided. The micro-electro-mechanical microphone includes a diaphragm, which is formed on a surface of one side of a semiconductor substrate, exposed to the outside surroundings, and can vibrate freely under the pressure generated by sound waves; an electrode plate with air holes, which is under the diaphragm; an isolation structure for fixing the diaphragm and the electrode plate; an air gap cavity between the diaphragm and the electrode plate, and a back cavity under the electrode plate and in the semiconductor substrate; and a second cavity formed on the surface of the same side of the semiconductor substrate and in an open manner The air gap cavity is connected with the back cavity through the air holes of the electrode plate The back cavity is connected with the second cavity through an air groove formed in the semiconductor substrate.

13 Claims, 23 Drawing Sheets

(51) Int. Cl.

| | |
|---|---|
| ***H04R 9/08*** | (2006.01) |
| ***H04R 19/00*** | (2006.01) |
| ***H04R 19/04*** | (2006.01) |
| ***H04R 31/00*** | (2006.01) |

(56) References Cited

U.S. PATENT DOCUMENTS

| | | | | |
|---|---|---|---|---|
| 7,781,249 | B2 * | 8/2010 | Laming et al. | 438/51 |
| 7,849,583 | B2 | 12/2010 | Horimoto et al. | |
| 7,951,636 | B2 * | 5/2011 | Lee et al. | 438/53 |
| 2007/0291964 | A1 | 12/2007 | Chien et al. | |
| 2009/0169035 | A1 | 7/2009 | Rombach et al. | |
| 2011/0189804 | A1 * | 8/2011 | Huang et al. | 438/53 |

FOREIGN PATENT DOCUMENTS

| | | | |
|---|---|---|---|
| CN | 101427593 | A | 5/2009 |
| CN | 101355827 | B | 1/2012 |
| CN | 102348155 | B | 2/2014 |
| EP | 1992588 | A2 | 11/2008 |

* cited by examiner

METHOD FOR MANUFACTURING A MICRO-ELECTRO-MECHANICAL MICROPHONE

CROSS-REFERENCE TO RELATED APPLICATIONS

The present application is a Section 371 National Stage Application of International Application No. PCT/CN2011/070649, filed on Jan. 26, 2011, which claims priority to Chinese patent application No. 201010244213.0, filed on Jul. 30, 2010, and entitled "MICRO-ELECTRO-MECHANICAL MICROPHONE AND MANUFACTURING METHOD THEREOF", the entire disclosures of which are incorporated herein by reference.

FIELD OF THE DISCLOSURE

The present disclosure generally relates to semiconductor manufacturing field, and more particularly, to a capacitive micro-electro-mechanical microphone and a manufacturing method thereof.

BACKGROUND OF THE DISCLOSURE

Micro-electro-mechanical (MEMS) is a technology for manufacturing microelectronic devices using semiconductor process. Compared with conventional electro-mechanical devices, MEMS devices have significant advantages of high temperature resistance, small sizes, and low power consumption. For example, a microphone made using MEMS technology is widely used in portable electronic devices because of its small sizes, which is easier to be integrated into ICs, and high sensitivity. Microphone is a transducer for converting an audio signal to an electrical signal. There are mainly three types of microphones according to operational principle, including piezoelectric type, resistance type and capacitive type. The capacitive microphone predominates in the MEMS microphone due to its high sensitivity, low noise, low distortion and low power consumption.

A completed MEMS microphone usually experiences an etch process in its manufacturing processes, so as to form a diaphragm, an electrode plate, an air gap cavity between them. Chinese Patent No. 200710044322.6 discloses a MEMS microphone and a method for manufacturing the same. FIG. 1 illustrates a schematic sectional view of a conventional MEMS microphone. FIG. 2 illustrates a schematic 3D view of the MEMS microphone shown in FIG. 1. Referring to FIG. 1 and FIG. 2, the conventional MEMS microphone includes: an electrode plate 11 on a top surface of a substrate 10 and having air holes therein; a diaphragm 12 under the electrode plate 11, where an air gap cavity 13 is formed between the diaphragm 12 and the electrode plate 11; and a back cavity 14 on the bottom surface and opposite to the diaphragm 12, which makes the diaphragm 12 suspending between the air gap cavity 13 and the back cavity 14.

The operational principle of the conventional MEMS microphone is as follows: the diaphragm 12 suspending between the air gap cavity 13 and the back cavity 14 may sense sound waves to vibrate freely because the back cavity 14 is open, and air therein may come in and go out freely through the air holes in the electrode plate 11. The distance between the electrode plate 11 and the diaphragm 12 changes regularly with the vibration, so does the capacitance formed by the electrode plate 11, the diaphragm 12 and air therebetween. The variation of the capacitance is output in electric signals, thereby converting audio signals into electric signals.

However, the conventional MEMS microphone has the following disadvantages: a great deal of spaces in the substrate is occupied because the MEMS microphone runs through the whole substrate with the back cavity 14 formed by an etching process. Further, the opening size of the back cavity 14 is difficult to be reduced due to the thick substrate, which causes difficulties in scaling-down devices and integrating the MEMS microphone into a semiconductor chip.

SUMMARY

Embodiments of the present disclosure provide a micro-electro-mechanical (MEMS) microphone which is formed on a surface of one side of a semiconductor substrate. The MEMS microphone according to the present disclosure is compatible with the CMOS process and is easy to be integrated in a semiconductor chip.

One embodiment of the present disclosure provides a MEMS microphone. The MEMS microphone may include:

a diaphragm formed on a surface of one side of a semiconductor substrate, which is exposed to an external environment and may vibrate freely under the pressures generated by sound waves;

an electrode plate under the diaphragm and having air holes therein;

an isolation structure for fixing the diaphragm and the electrode plate;

an air gap cavity formed between the diaphragm and the electrode plate;

a back cavity formed under the electrode plate and in the semiconductor substrate; and a second cavity formed on the surface of the same side of the semiconductor substrate and in an open manner;

where the air holes in the electrode plate join the air gap cavity and the back cavity, and an air groove formed in the semiconductor substrate joins the back cavity and the second cavity.

One embodiment of the present disclosure provides a method for manufacturing a micro-electro-mechanical microphone. The method may include:

providing a semiconductor substrate;

forming a first groove, a second groove and a connecting groove on a surface of the semiconductor substrate, the connecting groove joining the first groove and the second groove;

forming a first sacrificial layer in the first groove;

forming an electrode plate with air holes on the first sacrificial layer, the electrode plate stretching across the first groove and extending to the surface of the semiconductor substrate;

forming a second sacrificial layer on the electrode plate, the second sacrificial layer connecting to the first sacrificial layer;

forming a diaphragm on the second sacrificial layer;

forming an isolation structure; and removing the first sacrificial layer and the second sacrificial layer.

In some embodiments, forming an isolation structure and removing the first sacrificial layer and the second sacrificial layer may include:

forming an isolation layer on the first sacrificial layer, the second sacrificial layer, the diaphragm and the semiconductor substrate;

forming a plurality of through holes by etching the isolation layer, the plurality of through holes exposing the first sacrificial layer;

removing the first sacrificial layer and the second sacrificial layer through the plurality of through holes;

forming a cover layer on the isolation layer, the cover layer sealing the plurality of through holes; and etching the cover layer and the isolation layer successively to form a third groove which exposes the diaphragm, where the isolation layer and cover layer serve as the isolation structure for fixing the electrode plate and the diaphragm.

One embodiment of the present disclosure provides a MEMS microphone. The MEMS microphone may include:

an electrode plate having air holes formed therein on a surface of one side of a semiconductor substrate, the electrode plate being exposed to an external environment;

a diaphragm under the electrode plate, which may vibrate freely under the pressures generated by sound waves;

an isolation structure for fixing the diaphragm and the electrode plate;

an air gap cavity formed between the diaphragm and the electrode plate;

a back cavity formed under the diaphragm and in the semiconductor substrate; and a second cavity formed on the surface of the same side of the semiconductor substrate and in an open manner;

where the air gap cavity is exposed to the external environment through the air holes in the electrode plate, and an air groove formed in the semiconductor substrate joins the back cavity and the second cavity.

One embodiment of the present disclosure provides a method for manufacturing a micro-electro-mechanical microphone. The method may include:

providing a semiconductor substrate;

forming a first groove, a second groove and a connecting groove on a surface of the semiconductor substrate, the first groove being connected to the second groove through the connecting groove;

forming a first sacrificial layer in the first groove;

forming a diaphragm on the first sacrificial layer, the diaphragm stretching across the first groove and extending to the surface of the semiconductor substrate;

forming a second sacrificial layer on the diaphragm, the first sacrificial layer being separated from the second sacrificial layer by the diaphragm;

forming an electrode plate with air holes on the second sacrificial layer, the air holes exposing the second sacrificial layer; and forming an isolation structure and removing the first sacrificial layer and the second sacrificial layer.

Optionally, forming an isolation structure and removing the first sacrificial layer and the second sacrificial layer may include:

forming an isolation layer on the first sacrificial layer, the second sacrificial layer and the semiconductor substrate except the location where the electrode plate is;

forming a plurality of through holes by etching the isolation layer, the plurality of through holes exposing the first sacrificial layer;

removing the first sacrificial layer and the second sacrificial layer through the plurality of through holes and the air holes of the electrode plate; and forming a cover layer on the isolation layer, the cover layer sealing the plurality of through holes, where the isolation layer and the cover layer serve as the isolation structure for fixing the electrode plate and the diaphragm.

Compared with the prior art, embodiments of this disclosure have the following advantages: the MEMS microphone is formed on a surface of one side of a semiconductor substrate by forming a back cavity in a semiconductor substrate and joining the back cavity and a second cavity by an air groove; the method for forming the MEMS microphone is compatible with the CMOS process which facilitates device scaling-down and integrating the MEMS microphone to a semiconductor chip.

BRIEF DESCRIPTION OF THE DRAWINGS

In order to clarify the objects, characteristics and advantages of the disclosure, embodiments of present disclosure will be described in detail hereinafter. The same reference numerals in different figures denote the same elements shown in prior art. Additionally, elements in the figures are not necessarily drawn to scale. For example, the dimensions of some of the elements in the figures may be exaggerated to help improve understanding of embodiments of the present disclosure.

FIG. 5*a* to FIG. 14*a* illustrate schematic top views of a method for manufacturing a MEMS microphone according to the first embodiment of the present disclosure;

FIG. 17*a* to FIG. 24*a* illustrate schematic top views of a method for manufacturing a MEMS microphone according to the second embodiment of the present disclosure.

DETAILED DESCRIPTION OF THE DISCLOSURE

In prior art, an etch process on the back surface of the semiconductor substrate is required during manufacturing a MEMS microphone to form a diaphragm for balancing the air pressure on both sides of the diaphragm, such that the diaphragm may vibrate freely by sensing sound waves. The conventional MEMS microphone may penetrate through the whole substrate, thereby occupying a great deal of substrate space and causing difficulties of device scaling-down. The MEMS microphone according to the present disclosure has a back cavity formed in a semiconductor substrate, which is connected to atmosphere through an air groove, such that the MEMS microphone is formed on a surface of one side of the semiconductor substrate. Hereinafter, embodiments of a MEMS microphone and a manufacturing method thereof will be described in detail.

A First Embodiment

Figure 3:
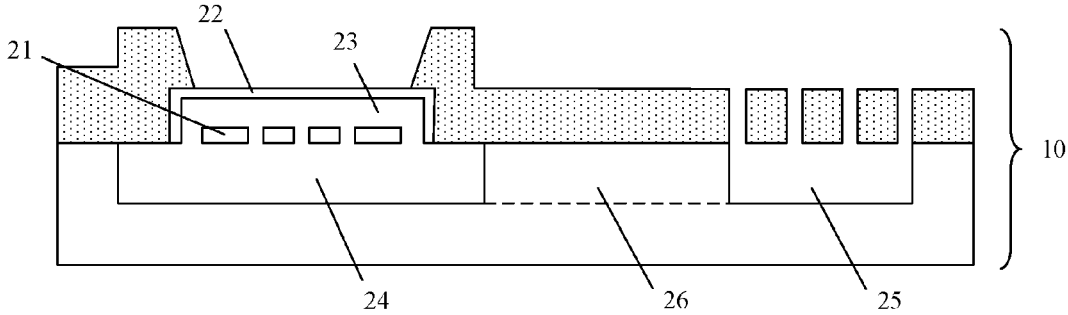
FIG. 3 illustrates a schematic sectional view of a MEMS microphone according to a first embodiment of the present disclosure.

FIG. 3 illustrates a schematic sectional view of a MEMS microphone according to the first embodiment of the present disclosure. Referring to FIG. 3, the MEMS microphone may include:

a diaphragm 22, which is formed on a surface of one side of a semiconductor substrate 10, exposed to an external environment, and may vibrate freely under the pressures generated by sound waves; an electrode plate 21 with air holes, which is under the diaphragm; an isolation structure for fixing the diaphragm and the electrode plate; an air gap cavity 23 formed between the diaphragm 22 and the electrode plate 21; a back cavity 24 formed under the electrode plate 21 and in the semiconductor substrate 10; where the air holes in the electrode plate 21 join the air gap cavity 23 and the back cavity 24.

The MEMS microphone further includes a second cavity 25 formed on the surface of the same side of the semiconductor substrate 10 and in an open manner. In FIG. 3, there is a cover plate with connection holes on the second cavity 25, which prevent dust entering the MEMS microphone. Compared to the MEMS microphone's size, the cover plate (cover layer) would not influence the second cavity 25 exposed to the external environment. An air groove 26 formed in the semiconductor substrate 10 joins the back cavity 24 and the second cavity 25.

The back cavity 24 is not formed in an open manner, which is connected to the second cavity 25 through the air groove 26. When sound waves propagate to the diaphragm 22 exposed to the external environment, the diaphragm 22 may vibrate under the pressures generated by sound waves. If the diaphragm 22 bends downwards, air in the air gap cavity 23 may exhaust to the outside through the air holes of the electrode plate 21, the back cavity 24, the air groove 26 and the second cavity 25 successively. If the diaphragm 22 bends upwards, air may enter into the air gap cavity 23 from the outside in an opposite way, thereby balancing air pressure on both sides of the diaphragm 22. It is known from the above, by connecting the back cavity 24 to the second cavity 25 through the air groove 26, an air path is formed for entry and exit.

Because the second cavity 25 and the air groove 26 are formed on a surface (top surface) of the same side of the semiconductor substrate 10, no etch process is required on the back surface (bottom surface) of the semiconductor substrate 10, which facilitates to improve device scaling-down.

In addition, the second cavity 25 is preferably formed far away from the back cavity 24, avoiding a poor vibration of the diaphragm 22 which results from the second cavity 25 receiving sound waves when a call is received, thereby influencing quality of the call.

Figure 4:
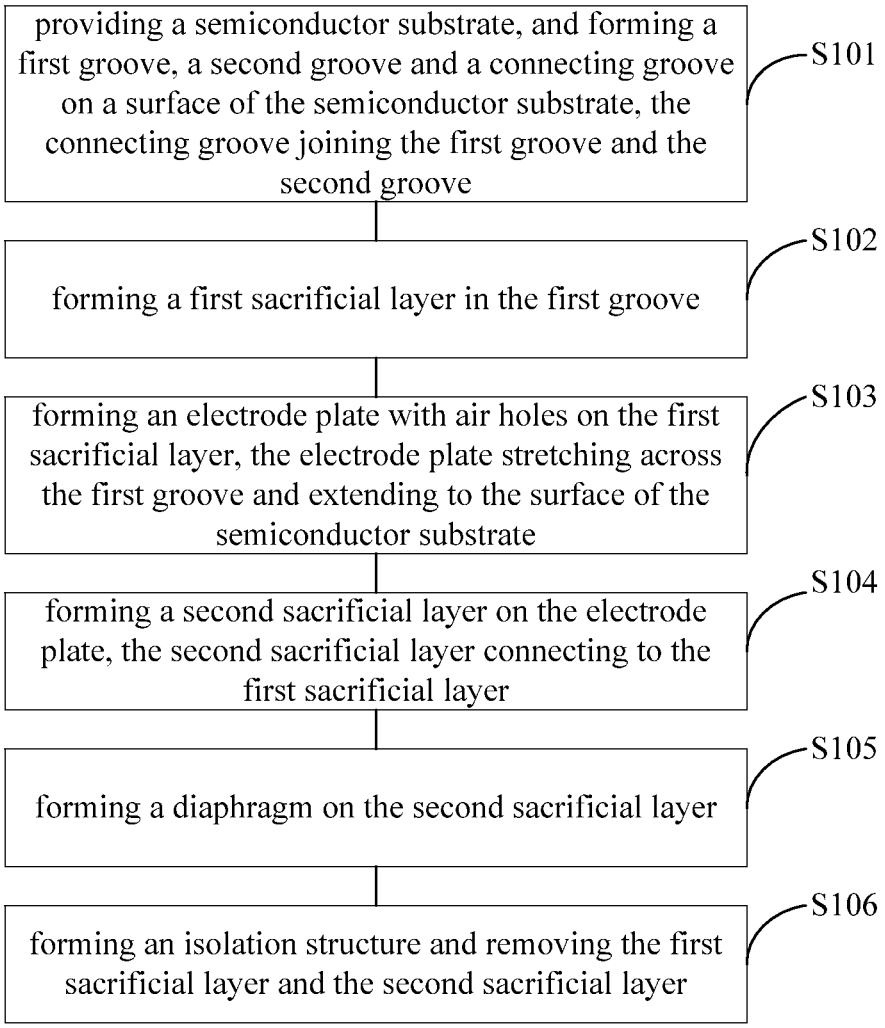
FIG. 4 illustrates a schematic flow chart of a method for manufacturing a MEMS microphone according to the first embodiment of the present disclosure.

To manufacturing the above MEMS microphone, embodiments provide a method for manufacturing a MEMS microphone. FIG. 4 illustrates a schematic flow chart of a method for manufacturing a MEMS microphone according to the first embodiment of the present disclosure. Referring to FIG. 4, the method may include:

S101, providing a semiconductor substrate, and forming a first groove, a second groove and a connecting groove on a surface of the semiconductor substrate, the connecting groove joining the first groove and the second groove;

The semiconductor substrate is a part of a wafer. The semiconductor substrate may be a monocrystalline silicon, or a silicon on insulator (SOI). Further, there are metal interconnection structures or other semiconductor devices formed on the semiconductor substrate. In some embodiments, the MEMS microphone according to the present disclosure may be manufactured based on a semiconductor chip on which a CMOS process is completed, so as to integrate the MEMS microphone with the semiconductor chip.

S102, forming a first sacrificial layer in the first groove;

A planarization process is performed after filling the first groove, such that a surface of the first sacrificial layer is flush with the surface of the semiconductor substrate. Further, the first sacrificial layer may be formed in the second groove and the connecting groove, so that a back cavity, an air groove and a second cavity may be formed simultaneously in subsequent processes.

S103, forming an electrode plate with air holes on the first sacrificial layer, the electrode plate stretching across the first groove and extending to the surface of the semiconductor substrate;

An electrode material is deposited on the first sacrificial layer and the semiconductor substrate, which is etched to form the electrode plate with air holes. The electrode plate may stretch across the first groove, and the first sacrificial layer is exposed from the bottom of the air holes. The electrode plate extending to the surface of the semiconductor substrate may be used to form metal interconnection which is connected to an external electrode and functions as a support.

S104, forming a second sacrificial layer on the electrode plate, the second sacrificial layer connecting to the first sacrificial layer;

The material of the second sacrificial layer may be the same as that of the first sacrificial layer. The second sacrificial layer may be formed only on the electrode plate, which is connected to the first sacrificial layer through the air holes. Optionally, the second sacrificial layer may be formed on the first sacrificial layer covering the electrode plate.

S105, forming a diaphragm on the second sacrificial layer;

The material of the diaphragm may be the same as that of the electrode plate. It should be noted that the diaphragm together with the electrode plate constitute two electrodes of a capacitance in the MEMS microphone, both of which are out of touch. Therefore, in S104, if the second sacrificial layer is formed only on the electrode plate, the diaphragm is formed only on a top surface of the second sacrificial layer accordingly, which prevents the diaphragm from extending to the electrode plate along a side surface of the second sacrificial layer.

S106, forming an isolation structure and removing the first sacrificial layer and the second sacrificial layer.

S106 is performed to form the back cavity and the air gap cavity and expose the diaphragm. Then the diaphragm and the electrode plate are connected to external electrodes.

It should be noted that, if the first sacrificial layer is formed in the second groove and the connecting groove in addition to the first groove in S102, the isolation structure may be formed covering the second groove and the connecting groove. As a result, the air groove and the second cavity may be formed as well as the back cavity and the air gap cavity when the first sacrificial layer is removed. If the first sacrificial layer is formed only in the first groove in S102, the air groove and the second cavity are needed to be formed in another step. For example, after the bottom electrode, the diaphragm, the air gap cavity and the back cavity is formed, a sacrificial dielectric is formed in the connecting groove and an isolation structure is formed on the sacrificial dielectric. The sacrificial dielectric is removed to form the air groove, and the second cavity is formed of the second groove.

Figure 5:
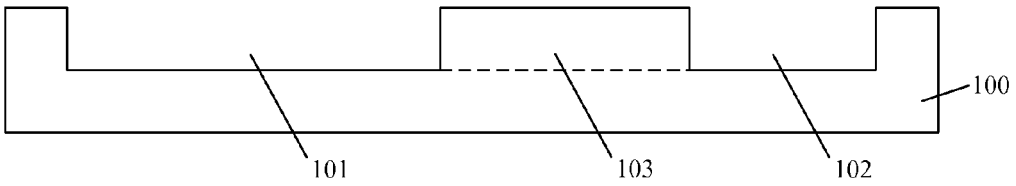
FIG. 5 to FIG. 14 illustrate schematic sectional views of a method for manufacturing a MEMS microphone according to the first embodiment of the present disclosure.

Hereunder, a complete process for manufacturing a MEMS microphone is provided. FIG. 5 to FIG. 14 illustrate schematic sectional views of a method for manufacturing a MEMS microphone according to the first embodiment of the present disclosure. FIG. 5*a* to FIG. 14*a* illustrate schematic top views of a method for manufacturing a MEMS microphone shown in FIG. 5 to FIG. 14. FIG. 5 is a sectional view along a line of A-A' shown in FIG. 5*a*, and FIG. 6 to FIG. 14 are shown corresponding to FIG. 6*a* to FIG. 14*a*, which are not described herein.

Figure 5A:
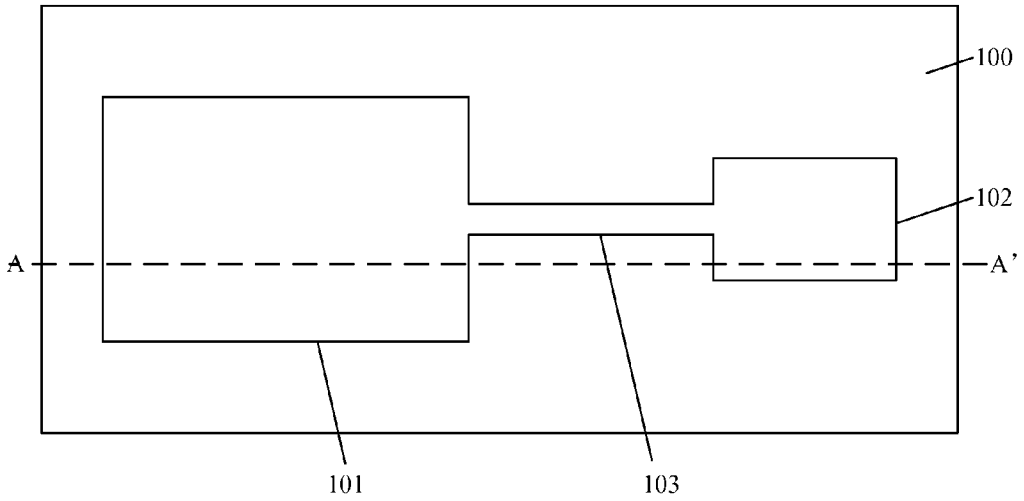

Referring to FIG. 5 and FIG. 5*a*, a semiconductor substrate 100 is provided. The semiconductor substrate 100 may be a monocrystalline silicon, or a silicon on insulator (SOI). Further, there are metal interconnection structures or other semiconductor devices (not shown) formed on the semiconductor substrate, so as to integrate the MEMS microphone with a semiconductor chip on which a CMOS process is completed. A first groove 101, a second groove 102 and a connecting groove 103 are formed on a surface of the semiconductor substrate 100. The connecting groove 103 connects the first groove 101 to the second groove 102.

The first groove 101 corresponds to a back cavity to be formed subsequently in the MEMS microphone. The second groove 102 corresponds to a second cavity, and the connecting groove 103 corresponds to an air groove. So the size and shape of the back cavity, the second cavity and the air groove depend on the dimensions of the first groove 101, the second groove 102 and the connecting groove 103, which are formed as required. In some embodiments, the first groove 101 has a depth of ranging from about 0.5 μm to about 50 μm. As described above, the second cavity needs to be formed far away from the back cavity, accordingly, the first groove 101 is far away from the second groove 102. For ease of manufacturing, the first groove 101, the second groove 102 and the connecting groove 103 have a shape of square, which can be formed using a plasma etch process. Specifically, the formation of the first groove 101, the second groove 102 and the connecting groove 103 may include: forming a photoresist layer on the semiconductor substrate 100; patterning the photoresist layer to define locations of the first groove 101, the second groove 102 and the connecting groove 103; etching the semiconductor substrate 100 to a predetermined depth using the patterned photoresist layer as a mask by using a plasma etch process.

Figure 6:
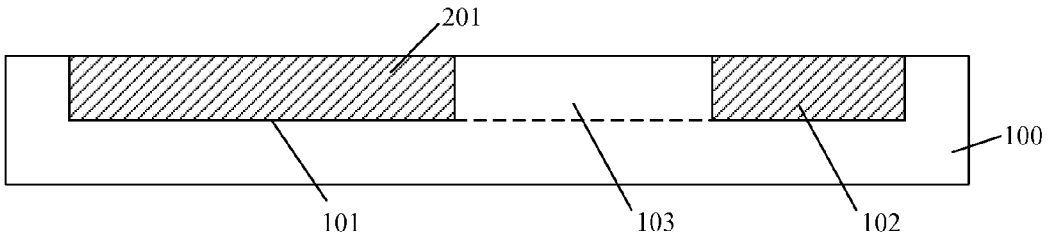
Figure 6A:
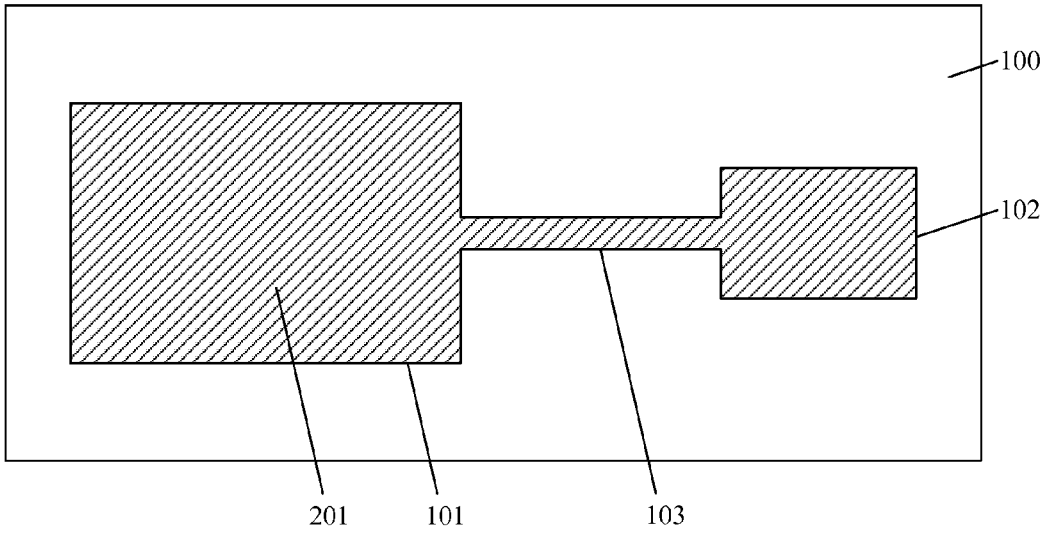

Referring to FIG. 6 and FIG. 6*a*, a sacrificial material is filled into the first groove 101, the second groove 102 and the connecting groove 103 to form a sacrificial layer 201. Then a planarization is performed on the sacrificial layer 201, such that a surface of the first sacrificial layer 201 is flush with the surface of the semiconductor substrate 100.

The first sacrificial layer 201 will be removed in subsequent process, so the sacrificial material is easy to be removed and different from the semiconductor substrate or other parts of the MEMS microphone. Preferably, the sacrificial material has an etch rate much greater than the semiconductor substrate, the diaphragm or the electrode plate, such that no damage is applied to the other parts of the MEMS microphone. In some embodiments, the first sacrificial layer 201 may employ a metal or the metal oxide which is easy to be removed by a wet etch process and may be deposited into the first groove 101, the second groove 102 and the connecting groove 103 using an electroplate process. In some embodiments, the first sacrificial layer 201 may employ a material which is easy to be removed using an evaporating method, for example, amorphous carbon, which may be deposited into the first groove 101, the second groove 102 and the connecting groove 103 using a Chemical Vapor Deposition (CVD) process. In the first embodiment, amorphous carbon is used as the sacrificial material, which has the following advantages: the CVD process is compatible with the existing CMOS process; the amorphous carbon is a compact material which is easy to be oxidized to form carbon dioxide at a lower temperature (no higher than 500° C.), so as to be removed using an evaporating method without leaving residual and damage to the other parts of the MEMS microphone. The process parameters of the CVD process may include: a temperature ranging from 350° C. to 500° C., a mixed gas including $C_3H_6$ and He. A Chemical Mechanical Polishing (CMP) method may be used to planarize the sacrificial material in the first groove 101, the second groove 102 and the connecting groove 103, such that the surface of the first sacrificial layer 201 is flush with the surface of the semiconductor substrate 100.

Figure 7:
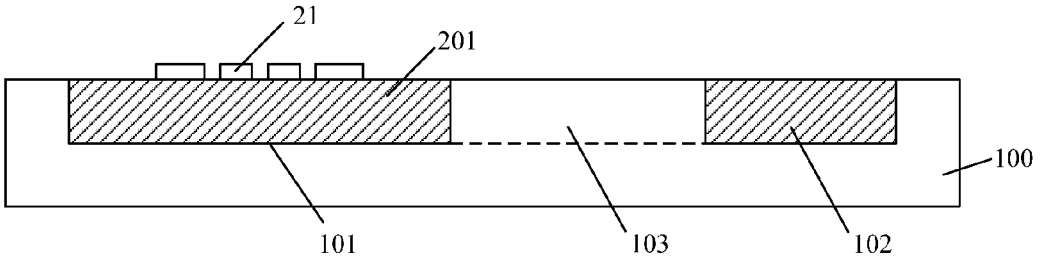
Figure 7A:
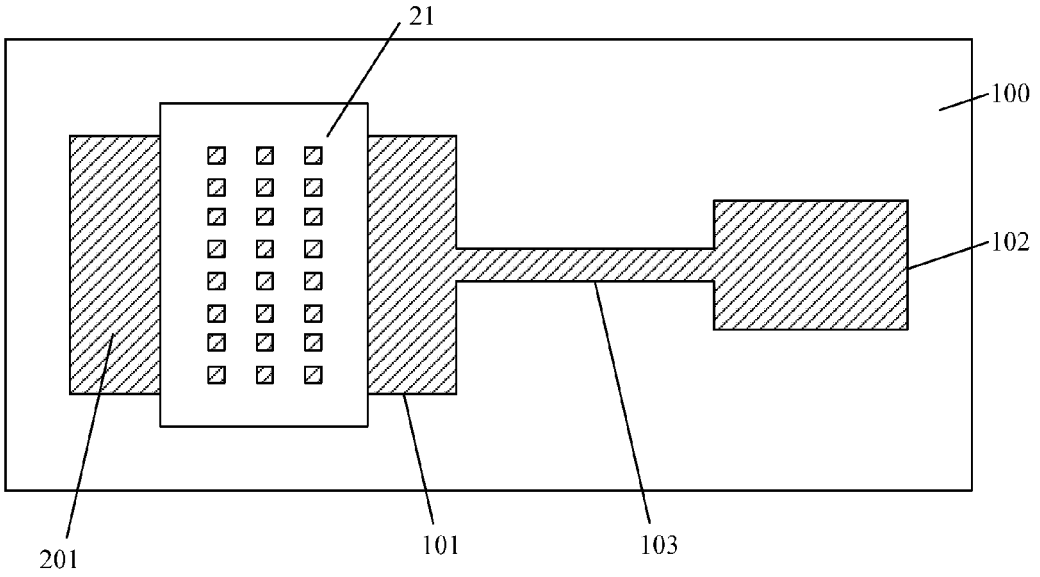

Referring to FIG. 7 and FIG. 7*a*, an electrode plate 21 with air holes is formed on the first sacrificial layer 201, the electrode plate 21 stretching across the first groove 101 and extending to the surface of the semiconductor substrate 100.

In some embodiments, an electrode plate material may be deposited on the surface of the first sacrificial layer 201 and the semiconductor substrate 100. Then a plasma etch process may be used to form the electrode plate 21 to a predetermined shape and dimension. Specifically, the electrode plate material may be different from the sacrificial material, which may be a metal including aluminum, titanium, zinc, silver, gold, copper, tungsten, cobalt, nickel, tantalum, platinum and the like. The electrode plate 21 may stretch across the first groove 101, and the first sacrificial layer 201 is exposed from a bottom of the air holes. In the first embodiment, the electrode plate 21 is made of copper. The copper material may be deposited on the surface of the first sacrificial layer 201 and the semiconductor substrate 100 using a PVD process, which has a depth ranging from 0.1 μm to 4 μm. Then a plasma etch process is used to form the electrode plate 21 and air holes in the electrode plate 21. During the plasma etch process, the copper material not to be etched is protected by a mask, so the electrode plate 21 has a thickness equal to that of the deposited copper. The electrode plate 21 may have a shape of rectangle, having a shorter side and a longer side. The electrode plate 21 stretches across the first groove 101 along the longer side, and two shorter sides are connected to the semiconductor substrate 100, such that the electrode plate 21 may be connected to an external electrode through a metal interconnection subsequently and functions as a support. The first sacrificial layer 201 is exposed along two shorter sides of the electrode plate 21, such that the first sacrificial layer 201 is easy to be removed subsequently.

In some embodiments, the electrode plate 21 may cover the first groove 101. Accordingly, the first sacrificial layer 201 may be removed through the connecting groove 103 or through an opening formed by etching the electrode plate 21.

Figure 8:
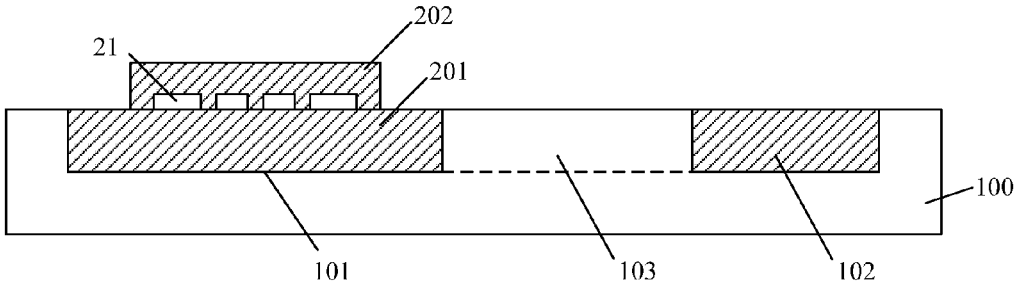
Figure 8A:
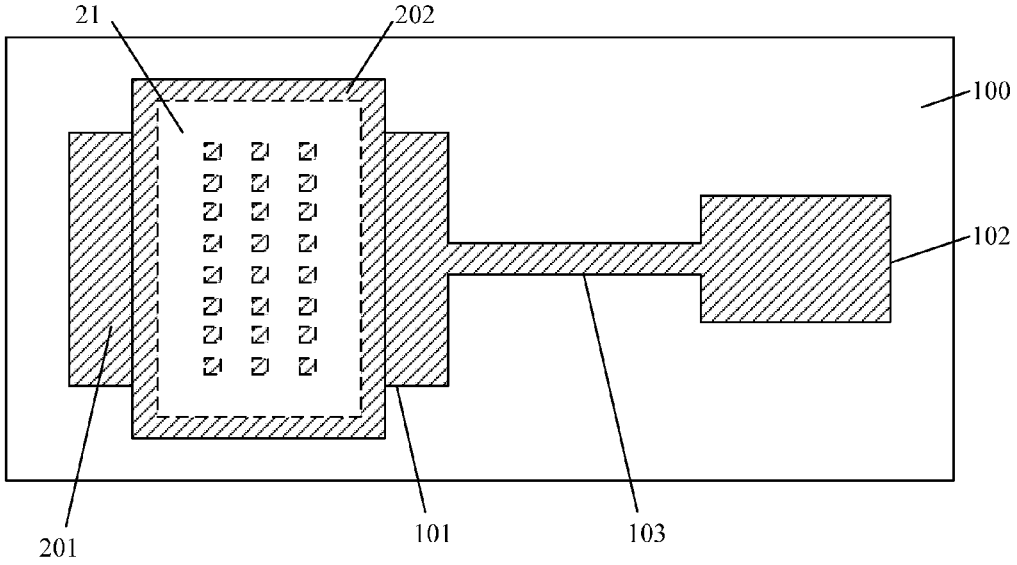

Referring to FIG. 8 and FIG. 8*a*, a second sacrificial layer 202 is formed on the electrode plate 21, the second sacrificial layer 202 being connected to the first sacrificial layer 201.

Generally, in order to simplify processes, the second sacrificial layer 202 may be made of the same material and using the same process as the first sacrificial layer 201. Due to the air holes in the electrode plate 21, the second sacrificial layer 202 may be formed only on the electrode plate 21, which is connected to the first sacrificial layer 201 through the air holes. Optionally, the second sacrificial layer 202 may be formed on the first sacrificial layer 201 covering the electrode plate 21. In the first embodiment, the first sacrificial layer 201 is exposed along two shorter sides of the electrode plate 21, so the second sacrificial layer 202 may cover the electrode plate 21 along two shorter sides of the electrode plate 21. As a result, the second sacrificial layer 202 is connected to the exposed first sacrificial layer 201 and extends to the surface of the semiconductor substrate 100 along two longer sides of the electrode plate 21. The dimension of the air gap cavity of the MEMS microphone depends on the shape and thickness of the second sacrificial layer 202, which may be formed as required. In some embodiments, the second sacrificial layer 202 may have a shape of square, and have a thickness ranging from 0.2 μm to 20 μm.

Figure 9:
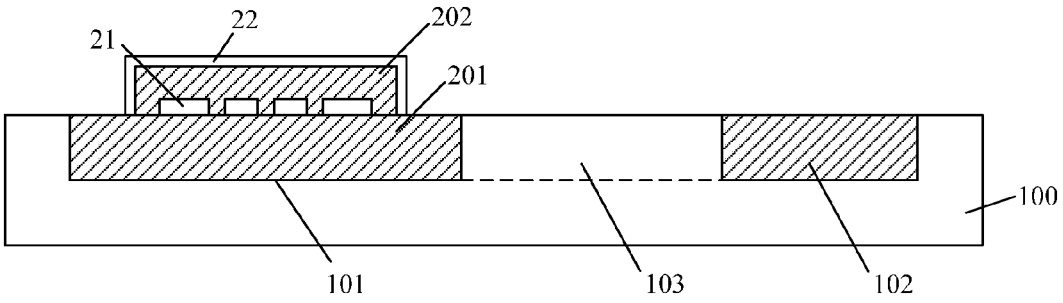
Figure 9A:
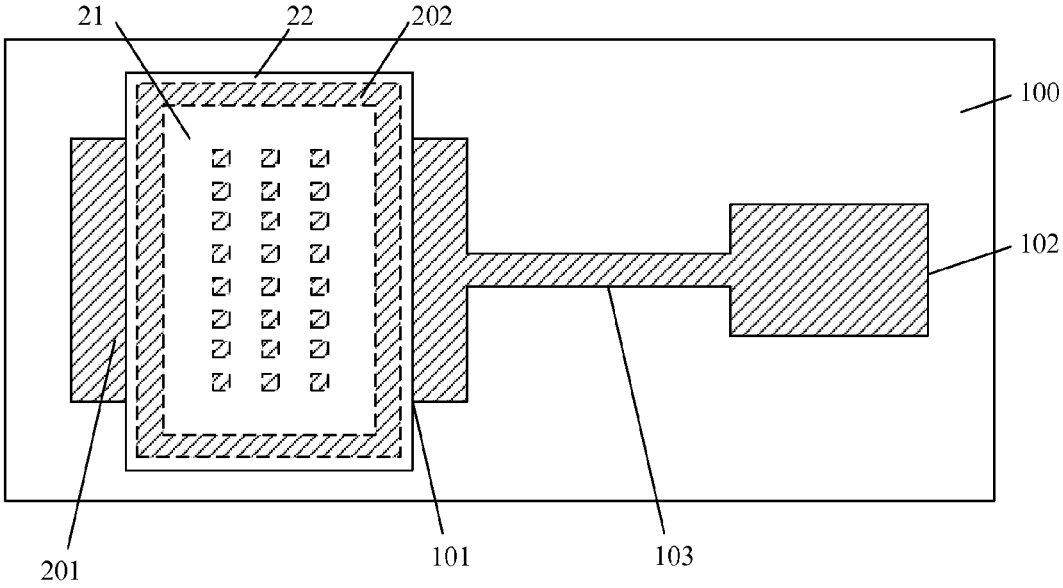

Referring to FIG. 9 and FIG. 9*a*, a diaphragm 22 is formed on the second sacrificial layer 202. The diaphragm 22 may be made of a metal including aluminum, titanium, zinc, silver, gold, copper, tungsten, cobalt, nickel, tantalum, platinum and the like; or a conductive non-metal including polysilicon, amorphous silicon, silicon germanium and the like; or a combination of metal with an insulating layer, or a combination of conductive non-metal with an insulating layer, wherein the insulating layer includes silicon oxide, silicon oxynitride, silicon nitride, carbon silicon compounds and aluminum oxide. In order to simplify processes, the material and the formation of the diaphragm 22 is the same as that of the electrode plate 21. In some embodiments, a copper material may be deposited to a certain thickness on the semiconductor structure shown in FIG. 8. Then a plasma etch process may be performed on the copper material to form the diaphragm 22 with a predetermined size and shape. Generally, in order to sense pressure generated by sound waves precisely, the diaphragm 22 may have a depth thinner than the electrode plate 21. For example, the diaphragm 22 may have a depth ranging from 0.05 μm to 4 μm.

As described in S105, the diaphragm 22 may not be connected to the electrode plate 21. In the first embodiment, the electrode plate 21 is covered by the second sacrificial layer 202, so the diaphragm 22 may be formed on the whole surface of the second sacrificial layer 202. In some embodiments, the second sacrificial layer 202 does not cover the electrode plate 21, so attentions are required when forming the diaphragm 22 to prevent the diaphragm 22 from connecting to the electrode plate 21. Further, the diaphragm 22 may be formed only on a top surface of the second sacrificial layer 202.

It should be noted, if materials of the second sacrificial layer 202 and the first sacrificial layer 201 include amorphous carbon, a deposition temperature may be no higher than 600° C. when a Physical Vapor Deposition (PVD) method is used to form the diaphragm 22 and the electrode plate 21 including metal materials, such that no damage is applied to the amorphous carbon.

Figure 10:
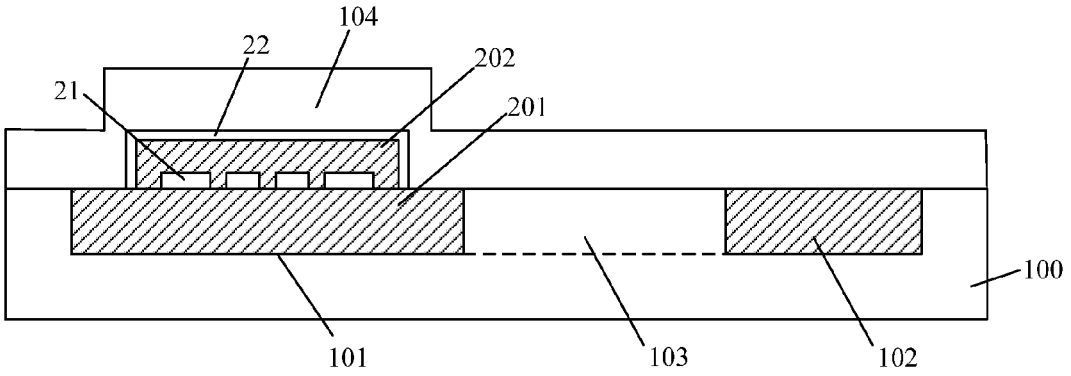
Figure 10A:
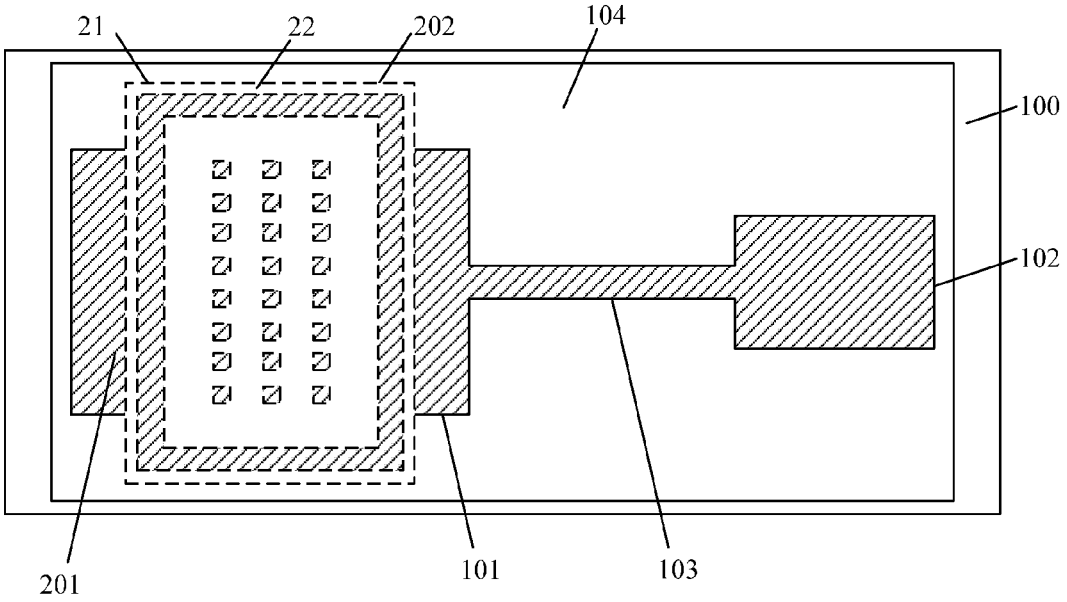

Referring to FIG. 10 and FIG. 10*a*, an isolation layer 104 is formed on the first sacrificial layer 201, the second sacrificial layer 202, the diaphragm 22 and the semiconductor substrate 100.

The isolation layer 104 may has functions of insulation. As the diaphragm 22 is formed on the second sacrificial layer 202, the isolation layer 104 may be formed at least on the first sacrificial layer 201 and the diaphragm 22. The isolation layer 104 may cover the connecting groove 103, the second groove 102 and the semiconductor substrate 100. The isolation layer 104 may be made of a conventional insulating material, such as silicon oxide or silicon nitride, which may be formed using a CVD method.

Figure 11:
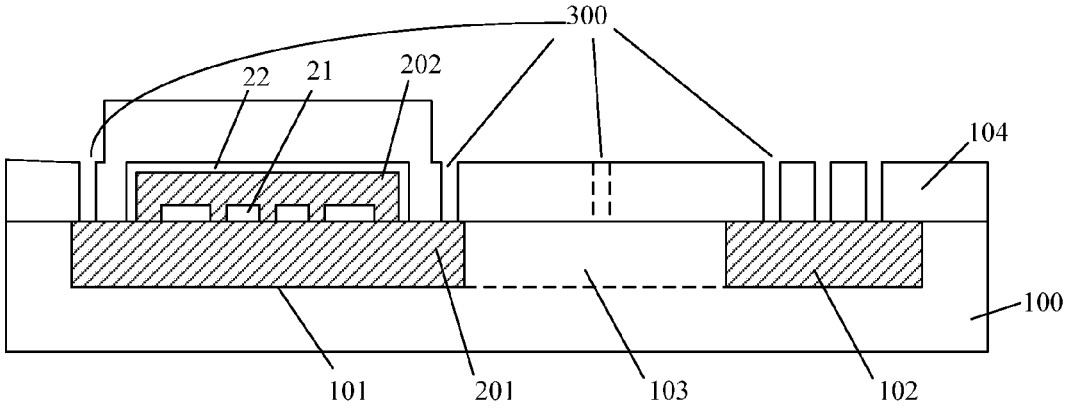
Figure 11A:
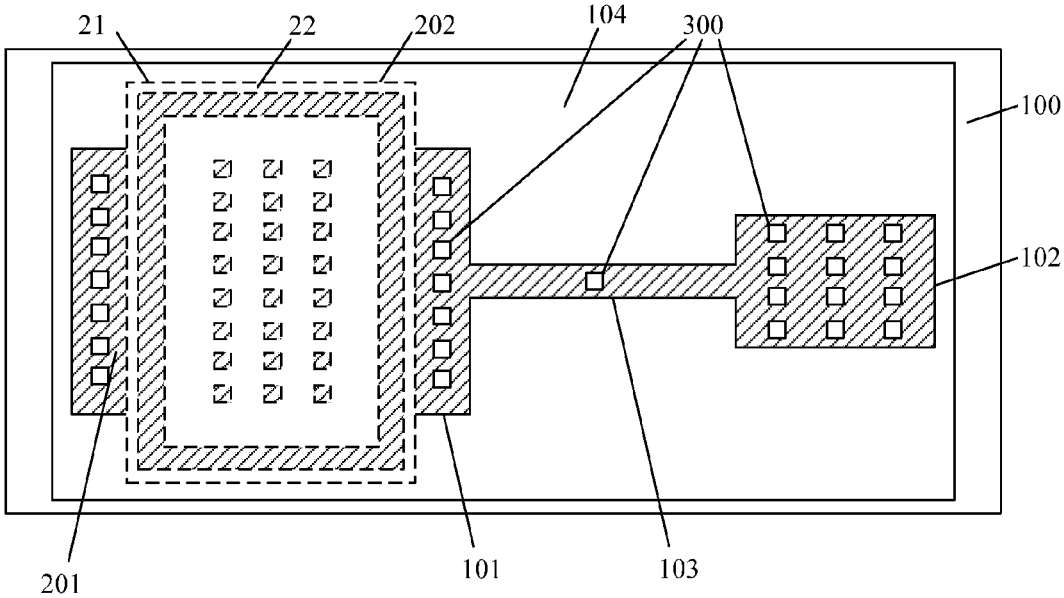

Referring to FIG. 11 and FIG. 11*a*, a plurality of through holes 300 are formed in the isolation layer 104 from which the first sacrificial layer 201 is exposed. The through holes 300 may be formed using a plasma etch process. Gas or liquid may be fed into the through holes 300 to remove the first sacrificial layer 201 and the second sacrificial layer 202. The numbers and locations of the through holes 300 depend on the formation of the first sacrificial layer 201.

In the first embodiment, the first sacrificial layer 201 is formed not only in the first groove 101, but also in the connecting groove 103 and the second groove 102. Because the first groove 101 is far away from the second groove 102, the through holes 300 are formed not only in the first groove 101, but also in the connecting groove 103 and the second groove 102, such that the first sacrificial layer 201 may be removed rapidly. It should be noted that when the through holes 300 is formed in the first groove 101, the diaphragm 21 may be avoided being damaged. The depth to diameter ratio of the through holes 300 may not be too less, which may results in difficulties of sealing; and may not be too greater, which may influence the effect of removing the sacrificial material. The depth to diameter ratio of the through holes 300 may be selected depending on chemical property of the sacrificial material and a process employed to remove the sacrificial material. The person skilled in the art may adjust the depth to diameter ratio according to the above principle, and may obtain a preferable range by limited experiments.

Figure 12:
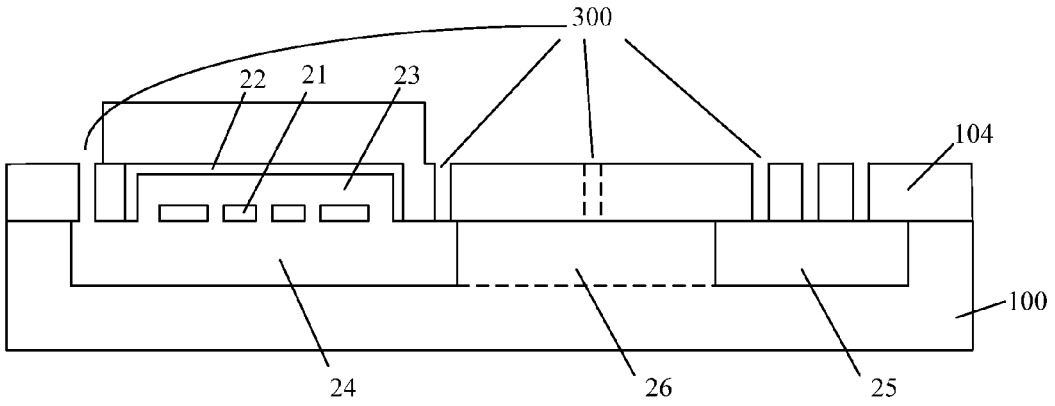
Figure 12A:
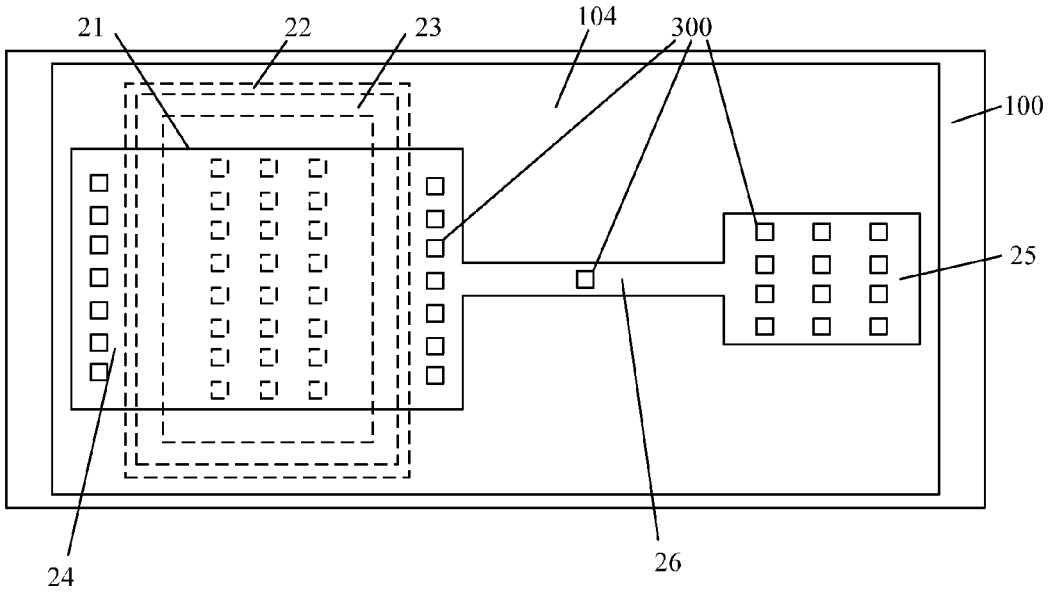

Referring to FIG. 12 and FIG. 12*a*, a remove material is fed into the isolation layer 104 through the through holes 300 to remove the first sacrificial layer 201 and the second sacrificial layer 202.

In the first embodiment, because the first sacrificial layer 201 and the second sacrificial layer 202 include a compact material, e.g., amorphous carbon, which is formed using a CVD method, the remove material may include oxide. In some embodiments, a process like an ash process may be used to remove the first sacrificial layer 201 and the second sacrificial layer 202. Specifically, in a plasma chamber containing $O_2$, the first sacrificial layer 201 and the second sacrificial layer 202 including amorphous carbon may be oxidized to generate gaseous oxide, like $CO_2$ or CO. A heating temperature may be from 100° C. to 350° C. At this temperature, there are no strong chemical reactions or even burn to the amorphous carbon. Instead, the amorphous carbon is oxidized softly and slowly to generate gaseous $CO_2$ or CO, which is exhausted via the through holes 300. In this way, the first sacrificial layer 201 and the second sacrificial layer 202 may be removed completely without damage to the other parts of the MEMS microphone. After the first sacrificial layer 201 and the second sacrificial layer 202 are removed, the first groove 101 under the electrode plate 21 constitutes the back cavity 24, the room where the second sacrificial layer 202 locates between the electrode plate 21 and the diaphragm constitutes the air gap cavity 23, and the connecting groove 103 and the second groove 102 respectively constitute the air groove 26 and the second cavity 25.

Figure 13:
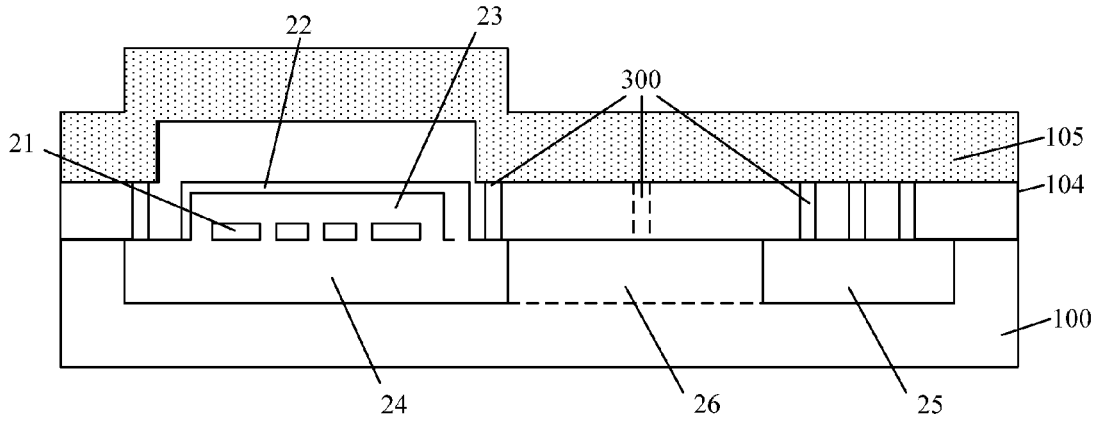
Figure 13A:
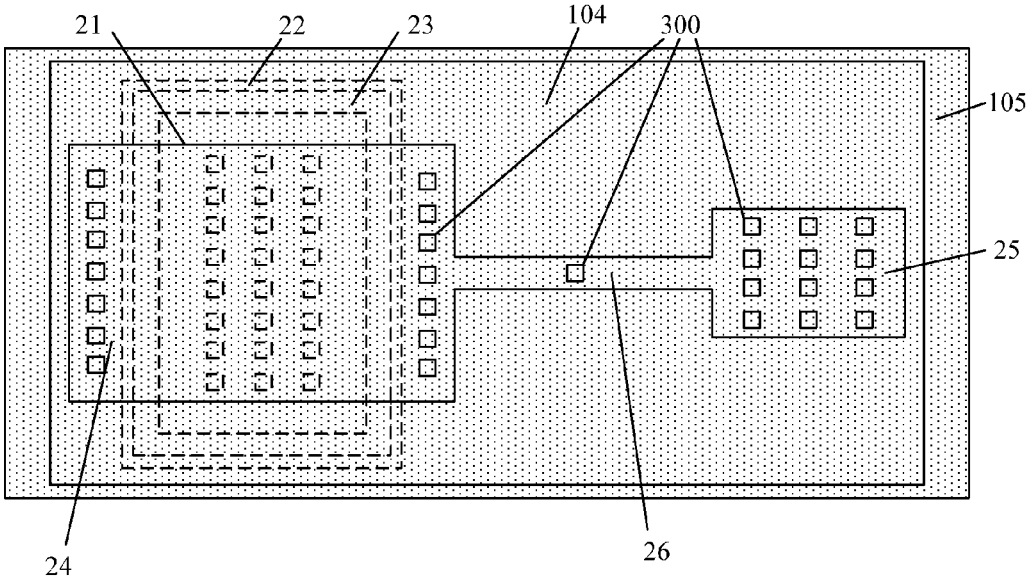

Referring to FIG. 13 and FIG. 13*a*, a cover layer 105 is formed on the isolation layer 104. The cover layer 105 may be formed using a CVD method. In the CVD process, the cover layer 105 is easy to seal the through holes 300 without penetrating to cavities in the isolation layer 104. In order to simplify processes, the cover layer 105 may use the same material as the isolation layer 104.

Figure 14:
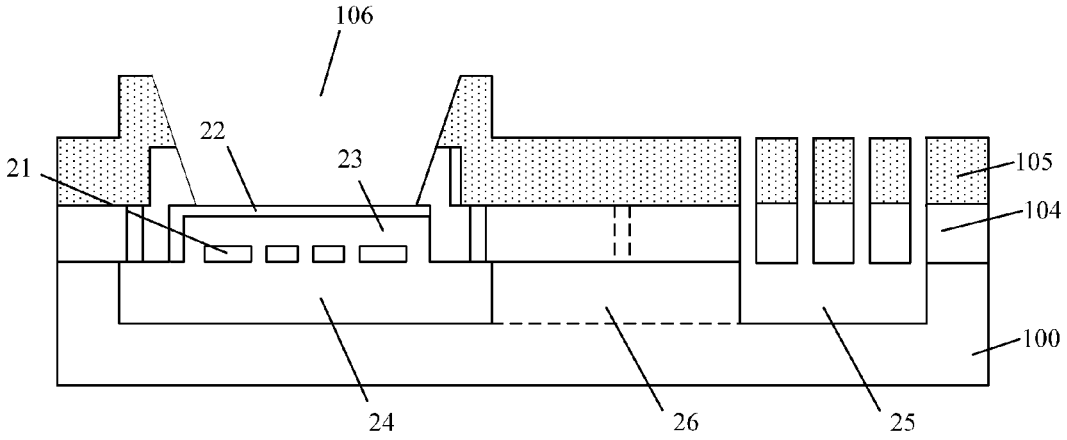
Figure 14A:
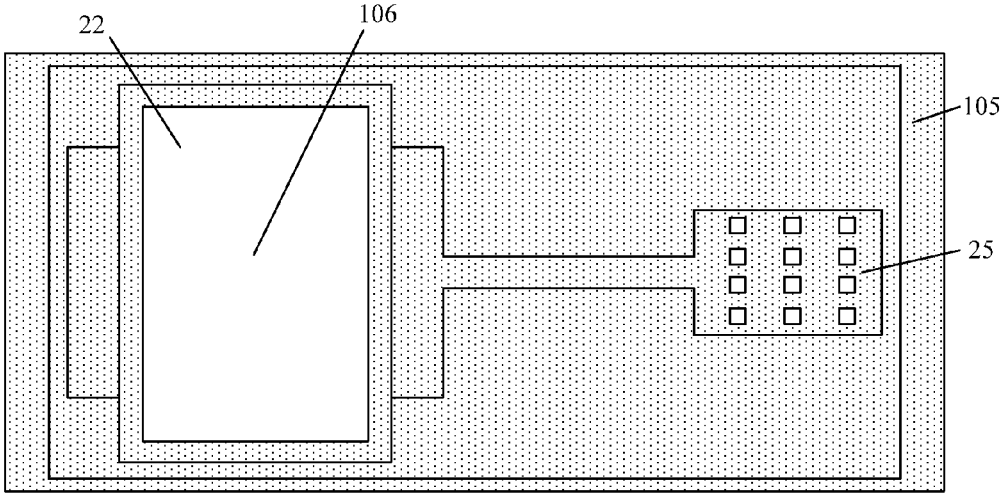

Referring to FIG. 14 and FIG. 14*a*, the cover layer 105 and the isolation layer 104 are etched successively to form a third groove 106, such that the diaphragm 22 is exposed from the third groove 106.

In FIG. 13, the diaphragm 22 is covered by the isolation layer 104 and the cover layer 105 formed previously. However, the diaphragm 22 needs to be exposed to external environment to sense sound waves. For this reason, a plasma etch process may be performed using the diaphragm 22 itself as an etch stop layer on the third groove 106, so that the diaphragm 22 is exposed.

In the first embodiment, the second cavity 25 formed by the second groove 102 may be sealed by the cover layer 105 formed on the isolation layer 104. However, the second cavity 25 may be in an open manner as described above. For this reason, the isolation layer 104 and the cover layer 105 formed on the second cavity 25 may be removed using the plasma etch process illustrated in FIG. 14, such that the second cavity 25 is exposed. Optionally, a plurality of connecting holes with greater dimensions may be formed in the isolation layer 104 and the cover layer 105 on the second cavity 25, which may keep the second cavity 25 open and prevent dust from entering into the MEMS microphone. In some embodiments, when the plurality of through holes 300 is formed in the isolation layer 104, they may be formed in the second groove 102. After the first sacrificial layer 201 is removed, the cover layer 105 may be formed on a part of the isolation layer 104 outside the second groove 102, such that the second groove 102 may be exposed to the external environment via the through holes 300.

The MEMS microphone shown in FIG. 3 is manufactured using the above processes. The isolation layer 104 and the cover layer 105 serve as an isolation structure for fixing and protecting the electrode plate 21 and the diaphragm 22. As the MEMS microphone is manufactured based on a semiconductor substrate, a metal interconnection may be formed in the semiconductor substrate or in the isolation structure, such that the electrode plate 21 and the diaphragm 22 may be connected to an external electrode. The metal interconnection process is known in the art, and will not be described in detail herein.

A Second Embodiment

Figure 15:
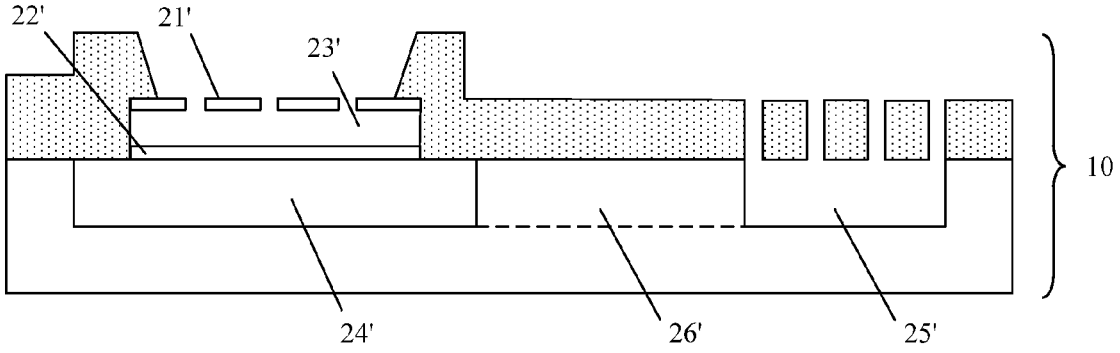
FIG. 15 illustrates a schematic sectional view of a MEMS microphone according to a second embodiment of the present disclosure.

A diaphragm in a MEMS microphone is a sensitive component for sensing sound waves, which is very fragile. According to the second embodiment, another MEMS microphone is provided shown in FIG. 15. FIG. 15 illustrates a schematic sectional view of a MEMS microphone according to the second embodiment of the present disclosure. Referring to FIG. 15, the MEMS microphone may include:

an electrode plate 21' with air holes, which is formed on a surface of one side of a semiconductor substrate 10, exposed to an external environment; a diaphragm 22', which is under the electrode plate 21' and can vibrate freely under the pressures generated by sound waves; an isolation structure for fixing the diaphragm 22' and the electrode plate 21'; an air gap cavity 23' formed between the diaphragm 22' and the electrode plate 21'; a back cavity 24' formed under the diaphragm 22' and in the semiconductor substrate 10.

The MEMS microphone further includes a second cavity 25' formed on the surface of the same side of the semiconductor substrate 10 and in an open manner. In FIG. 15, there is a cover plate (cover layer) with connection holes on the second cavity 25', which prevent dust entering the MEMS microphone. An air groove 26' formed in the semiconductor substrate 10 joins the back cavity 24' and the second cavity 25'.

The difference of the MEMS microphone between the first and second embodiments includes the following. The relative location of the electrode plate 21' and the diaphragm 22' is changed to form the diaphragm 22' under the electrode plate 21', such that the diaphragm 22' may be protected by the electrode plate 21' from exposing to the external environment. The air gap cavity 23' and the back cavity 24' are respectively located on both sides of the diaphragm 22' and are separated by the diaphragm 22'.

When sound waves outside propagate to the MEMS microphone, the sound waves may enter into the air gap cavity through the electrode plate 21', then to the diaphragm 22'. The air holes in the electrode plate 21' not only allow air in the air gap cavity flow therethrough, but also serve as transmission holes for the sound waves. Further, the diaphragm 22' may vibrate under the pressures generated by sound waves. If the diaphragm 22' bends downwards, air may enter into the air gap cavity 23' from the outside through the air holes of the electrode plate 21', and air in the back cavity 24' may exhaust to the outside through the air groove 26' and the second cavity 25', thereby balancing air pressure on both sides of the diaphragm 22'. If the diaphragm 22' bends upwards, air in the air gap cavity 23 may exhaust to the outside through the air holes of the electrode plate 21, and air may enter into the back cavity 24' through the second cavity 25' and the air groove 26'. Accordingly, in the second embodiment, the air gap cavity 23' is disconnected with the back cavity 24', both of which achieve air flow from the outside respectively through the air holes of the electrode plate 21' and through the second cavity 25' and the air groove 26'.

In the second embodiment, because the second cavity 25' and the air groove 26' are formed on a surface (top surface) of the same side of the semiconductor substrate 10, which is similar to the first embodiment, no etch process is required on the back surface (bottom surface) of the semiconductor substrate 10, which facilitates to improve device scaling-down.

In addition, the second cavity 25' is preferably formed far away from the back cavity 24', avoiding a poor vibration of the diaphragm 22' which results from the second cavity 25' receiving sound waves when a call is received, thereby influencing quality of the call.

Figure 16:
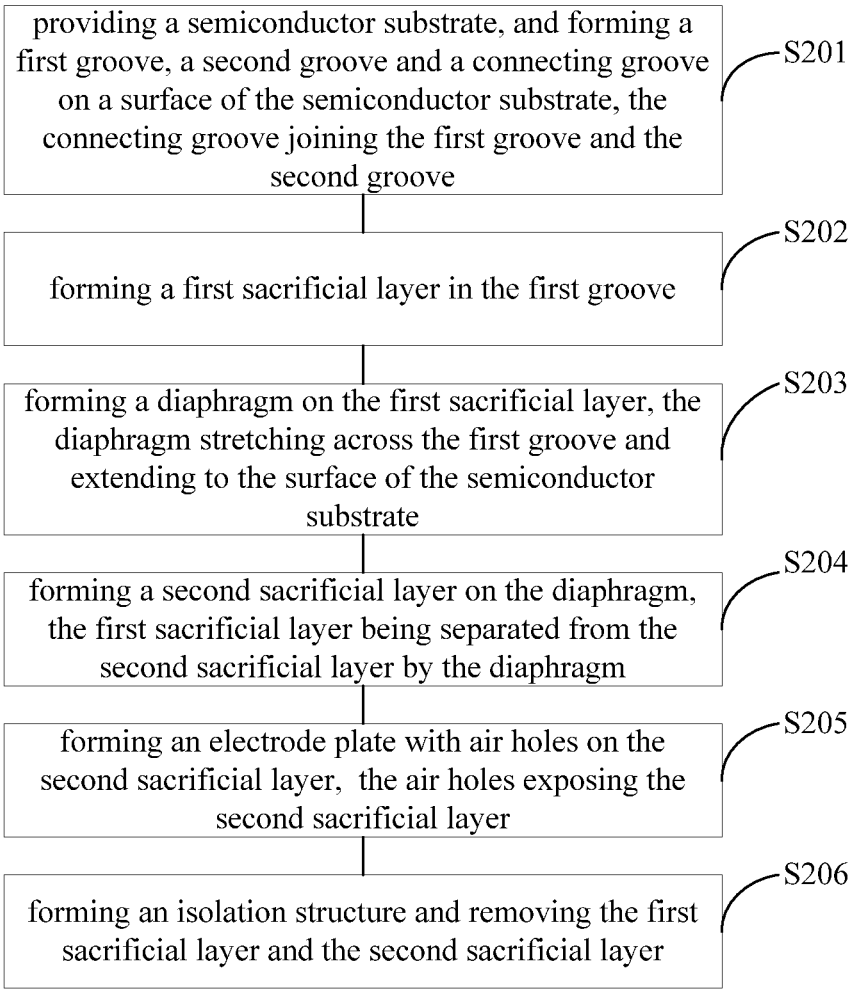
FIG. 16 illustrates a schematic flow chart of a method for manufacturing a MEMS microphone according to the second embodiment of the present disclosure.

To manufacturing the above MEMS microphone, embodiments provide a method for manufacturing a MEMS microphone. FIG. 16 illustrates a schematic flow chart of a method for manufacturing a MEMS microphone according to the second embodiment of the present disclosure. Referring to FIG. 16, the method may include:

S201, providing a semiconductor substrate, and forming a first groove, a second groove and a connecting groove on a surface of the semiconductor substrate, the connecting groove joining the first groove and the second groove;

S202, forming a first sacrificial layer in the first groove;

The steps of S201 and S202 may be the same as the steps of S101 and S102 in the first embodiment. The semiconductor substrate may be a monocrystalline silicon, or a silicon on insulator (SOI). Further, there are metal interconnection structures or other semiconductor devices formed on the semiconductor substrate. The first sacrificial layer may be formed in the second groove and the connecting groove.

S203, forming a diaphragm on the first sacrificial layer, the diaphragm stretching across the first groove and extending to the surface of the semiconductor substrate;

A diaphragm material is deposited on the first sacrificial layer and the semiconductor substrate, which is etched to form the diaphragm. The diaphragm may stretch across or cover the first groove. The diaphragm extending to the surface of the semiconductor substrate may be used to form metal interconnection which is connected to an external electrode and functions as a support.

S204, forming a second sacrificial layer on the diaphragm, the first sacrificial layer being separated from the second sacrificial layer by the diaphragm;

The material of the second sacrificial layer may be the same as that of the first sacrificial layer. The first sacrificial layer and the second sacrificial layer may be used to form a back cavity and an air gap cavity, both of which are disconnected, so the second sacrificial layer may be formed only on the diaphragm.

S205, forming an electrode plate with air holes on the second sacrificial layer, the air holes exposing the second sacrificial layer;

The material of the electrode plate may be the same as that of the diaphragm. It should be noted that the diaphragm together with the electrode plate constitute two electrodes of a capacitance in the MEMS microphone, both of which are out of touch. In the second embodiment, the second sacrificial layer is formed only on the diaphragm. The electrode plate is formed only on a top surface of the second sacrificial layer accordingly, which prevents the electrode plate from extending to the diaphragm along a side surface of the second sacrificial layer.

S206, forming an isolation structure and removing the first sacrificial layer and the second sacrificial layer.

S206 is performed to form the back cavity and the air gap cavity. Then the diaphragm and the electrode plate are connected to external electrodes. Different from the first embodiment, because the first sacrificial layer and the second sacrificial layer are disconnected, the back cavity and the air gap cavity are separated accordingly. And the electrode plate needs to be exposed to external environment. So the isolation structure is not formed covering the electrode plate. The first sacrificial layer and the second sacrificial layer may be removed through the air holes in the electrode plate and through holes formed in the isolation structure.

Similar to the first embodiment, if the first sacrificial layer is formed in the second groove and the connecting groove in addition to the first groove in S202, the isolation structure may be formed covering the second groove and the connecting groove. As a result, the air groove and the second cavity may be formed as well as the back cavity and the air gap cavity when the first sacrificial layer is removed. If the first sacrificial layer is formed only in the first groove in S202, the air groove and the second cavity are needed to be formed in another step.

Hereunder, a complete process for manufacturing a MEMS microphone is provided. Because the step of forming the first groove, the second groove and the connecting groove and the step of forming the first sacrificial layer may be similar to that in the first embodiment, the below process will be described based on the semiconductor structure shown in FIG. 6 and FIG. 6*a*.

FIG. 17 to FIG. 24 illustrate schematic sectional views of a method for manufacturing a MEMS microphone according to the second embodiment of the present disclosure. FIG. 17*a* to FIG. 24*a* illustrate schematic top views of a method for manufacturing a MEMS microphone according to the second embodiment of the present disclosure. FIG. 17*a* is a top view of FIG. 17, and FIG. 18*a* to FIG. 24*a* are shown corresponding to FIG. 18 to FIG. 24, which are not described herein.

Figure 17:
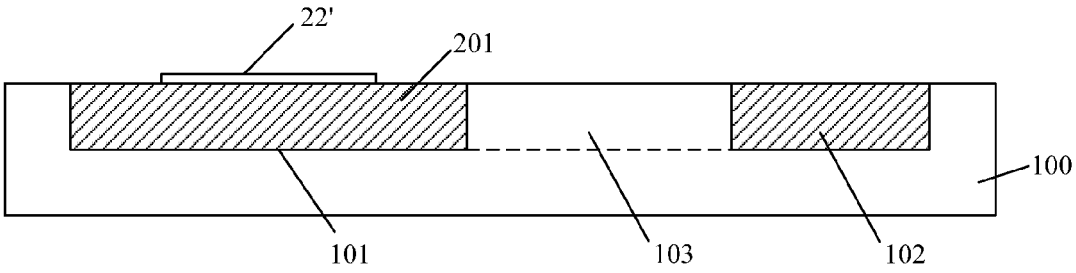
FIG. 17 to FIG. 24 illustrate schematic sectional views of a method for manufacturing a MEMS microphone according to the second embodiment of the present disclosure.
Figure 17A:
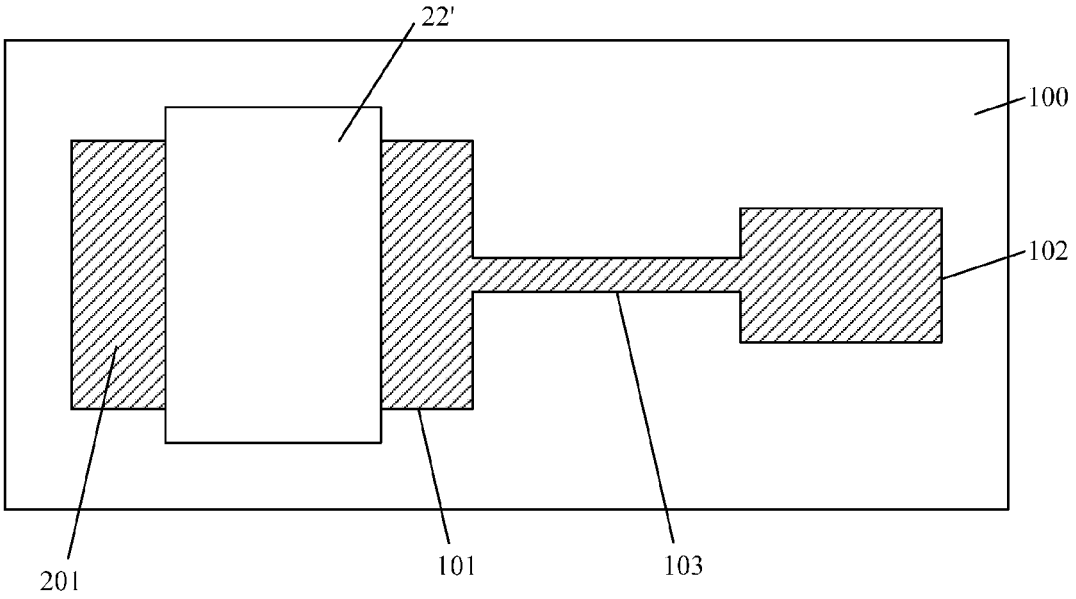

Referring to FIG. 17 and FIG. 17*a*, a diaphragm 22' is formed on the first sacrificial layer 201 based on the semiconductor structure shown in FIG. 6 and FIG. 6*a*. The diaphragm 22' stretches across the first groove 101 and extends to the surface of the semiconductor substrate 100.

In some embodiments, a diaphragm material may be deposited on the surface of the first sacrificial layer 201 and the semiconductor substrate 100. Then a plasma etch process may be used to form the diaphragm 22' to a predetermined shape and dimension. Specifically, the diaphragm material may be different from the sacrificial material. The diaphragm 22' may include materials same as that in the first embodiment. The diaphragm 22' may stretch across the first groove 101. In the second embodiment, the diaphragm 22' is made of copper. The copper material may be deposited on the surface of the first sacrificial layer 201 and the semiconductor substrate 100 a PVD process, which has a depth ranging from 0.05 μm to 4 μm. Then a plasma etch process is used to form the diaphragm 22' with the predetermined shape and dimension. The diaphragm 22' has a thickness equal to that of the deposited copper. The diaphragm 22' may have a shape of rectangle, having a shorter side and a longer side. The diaphragm 22' stretches across the first groove 101 along the longer side, and two shorter sides are connected to the semiconductor substrate 100, such that the diaphragm 22' may be connected to an external electrode through a metal interconnection subsequently and functions as a support. The first sacrificial layer 201 is exposed along two shorter sides of the diaphragm 22', such that the first sacrificial layer 201 is easy to be removed subsequently.

In some embodiments, the diaphragm 22' may cover the first groove 101. Accordingly, the first sacrificial layer 201 may be removed through the connecting groove 103 or through an opening formed by etching the diaphragm 22'.

Figure 18:
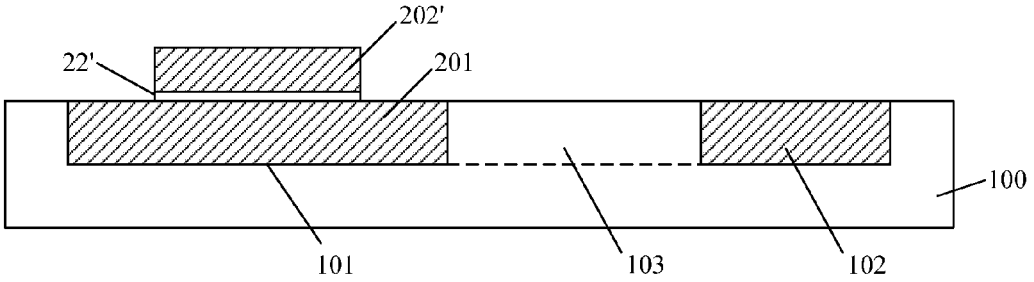
Figure 18A:
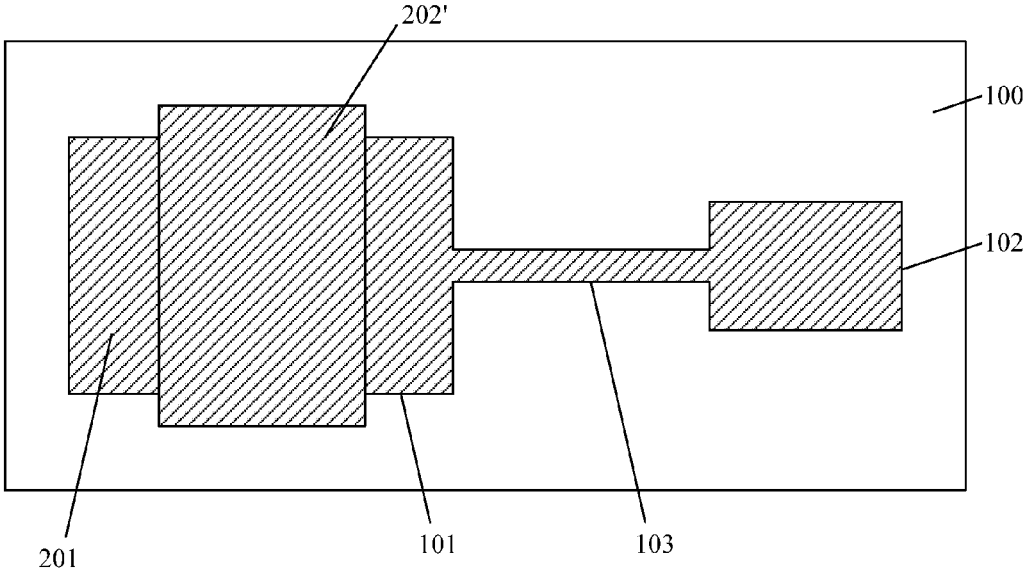

Referring to FIG. 18 and FIG. 18*a*, a second sacrificial layer 202' is formed on the diaphragm 22', the second sacrificial layer 202 being separated from the first sacrificial layer 201 by the diaphragm 22'.

In order to simplify processes, the second sacrificial layer 202' may be made of the same material and using the same process as the first sacrificial layer 201. The second sacrificial layer 202' may be formed on the diaphragm 22', such that the second sacrificial layer 202' is disconnected with the first sacrificial layer 201. The second sacrificial layer 202' extends to the surface of the semiconductor substrate 100 along two longer sides of the diaphragm 22'. The dimension of the air gap cavity of the MEMS microphone depends on the shape and thickness of the second sacrificial layer 202', which may be formed as required. In some embodiments, the second sacrificial layer 202' may have a shape of square which has a shorter side and a longer side corresponding to that of the diaphragm 22', and have a thickness ranging from 0.2 μm to 20 μm.

Figure 19:
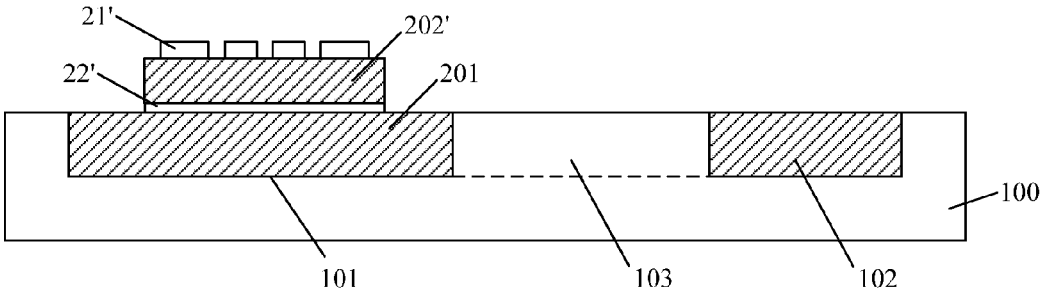
Figure 19A:
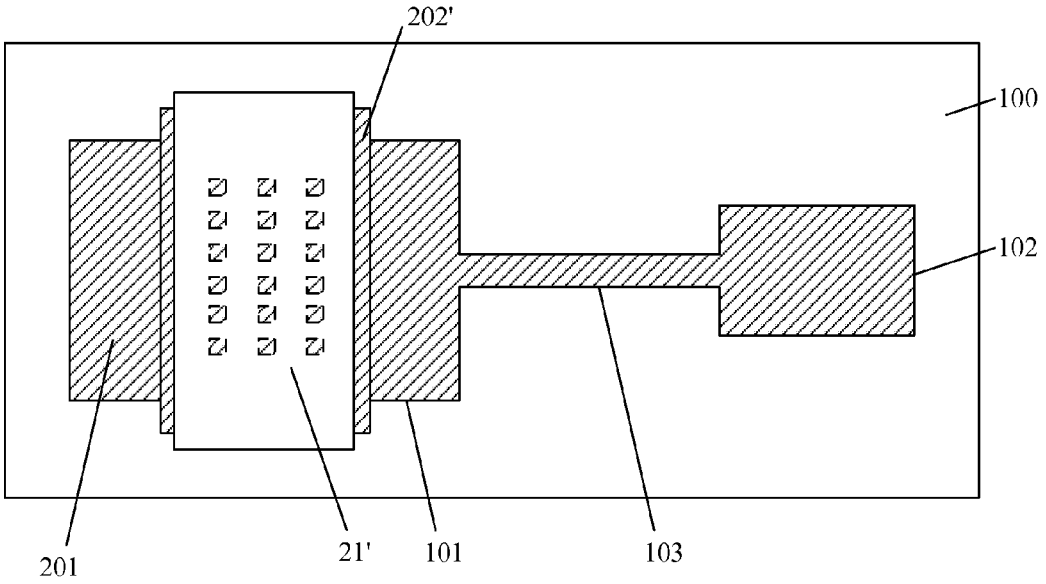

Referring to FIG. 19 and FIG. 19*a*, an electrode plate 21' with air holes is formed on the second sacrificial layer 202', the air holes exposing the second sacrificial layer 202'. The electrode plate 21' may include a material same as that in the first embodiment. In order to simplify processes, the electrode plate 21' may be made of the same material and using the same process as the diaphragm 22'.

Because the diaphragm 22' is out of touch with the electrode plate 21', the electrode plate 21' may be formed on a top surface of the second sacrificial layer 202', thereby extending to the surface of the semiconductor substrate 100 along two longer sides of the second sacrificial layer 202', rather than extending to the diaphragm 22' along two shorter sides of the second sacrificial layer 202'. Specifically, an electrode plate material may be deposited on the second sacrificial layer 202'. Then a plasma etch process is performed to form the electrode plate 21' and air holes with a predetermined shape. The second sacrificial layer 202' may be exposed from the bottom of the air holes. The electrode plate 21' may have a shape of square having a depth ranging from 0.1 μm to 4 μm.

In order to protect the second sacrificial layer 202' and the first sacrificial layer 201' including amorphous carbon, a deposition temperature may be no higher than 600° C. when a PVD method is used to form the diaphragm 22' and the electrode plate 21' including metal materials.

Figure 20:
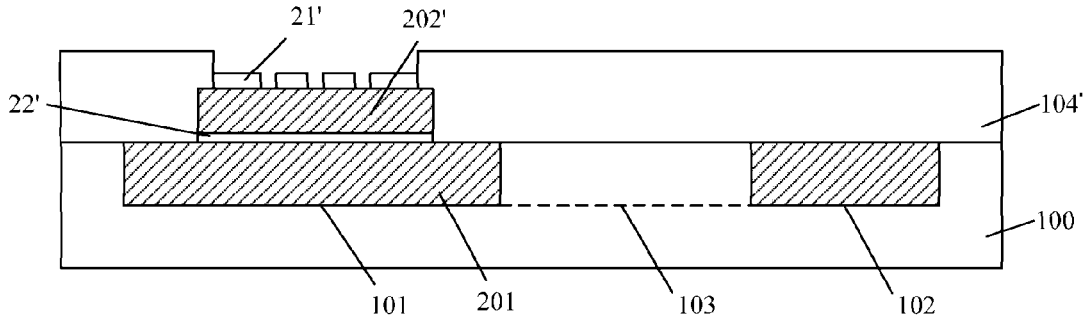
Figure 20A:
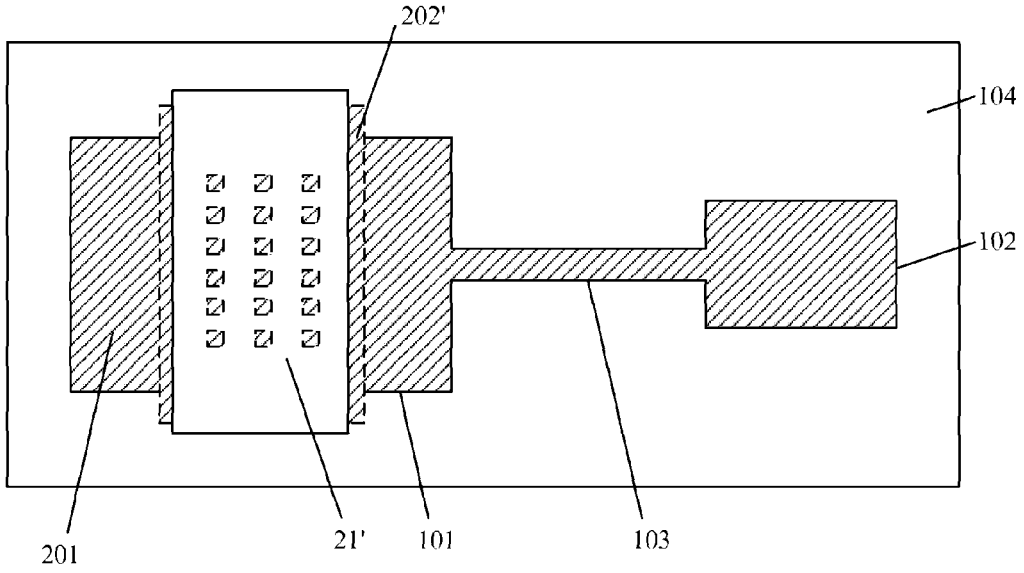

Referring to FIG. 20 and FIG. 20*a*, an isolation layer 104' is formed on the first sacrificial layer 201, the second sacrificial layer 202' and the semiconductor substrate 100 except for the electrode plate 21'.

The isolation layer 104 may has functions of insulation. Because the electrode plate 21' needs to be exposed to the external environment to prevent the air holes in the electrode plate 21' being sealed, the isolation layer 104' may not be formed on the electrode plate 21'. The isolation layer 104' may cover the connecting groove 103, the second groove 102 and the semiconductor substrate 100. The isolation layer 104' may be made of a conventional insulating material, such as silicon oxide or silicon nitride, which may be formed using a CVD method.

Figure 21:
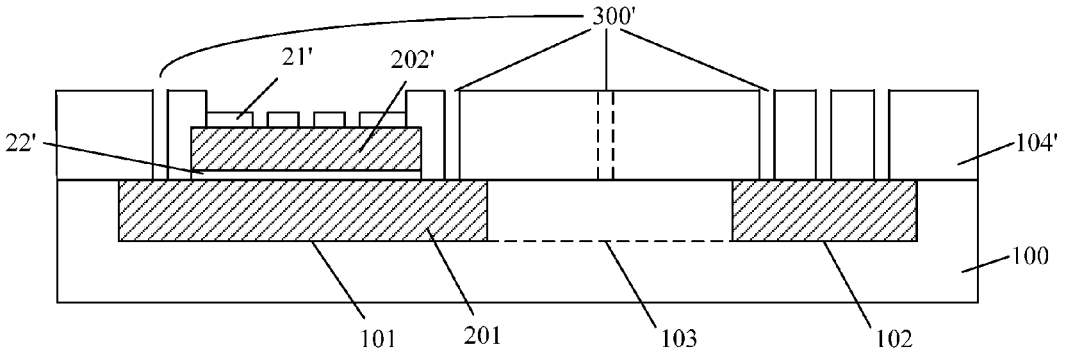
Figure 21A:
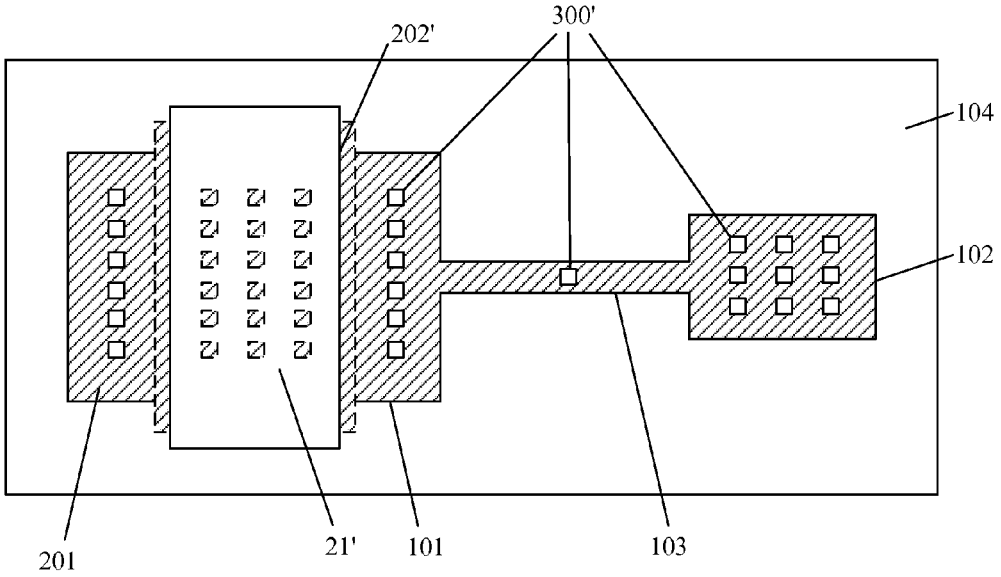

Referring to FIG. 21 and FIG. 21*a*, a plurality of through holes 300' are formed in the isolation layer 104' from which the first sacrificial layer 201 is exposed. The through holes 300' may be formed using a plasma etch process. Gas or liquid may be fed into the through holes 300' to remove the first sacrificial layer 201.

In the first embodiment, the first sacrificial layer 201 is formed not only in the first groove 101, but also in the connecting groove 103 and the second groove 102. Because the first groove 101 is far away from the second groove 102, the through holes 300' are formed not only in the first groove 101, but also in the connecting groove 103 and the second groove 102, such that the first sacrificial layer 201 may be removed rapidly. Similar to the first embodiment, the depth to diameter ratio of the through holes 300' may be selected depending on chemical property of the sacrificial material and a process employed to remove the sacrificial material.

Figure 22:
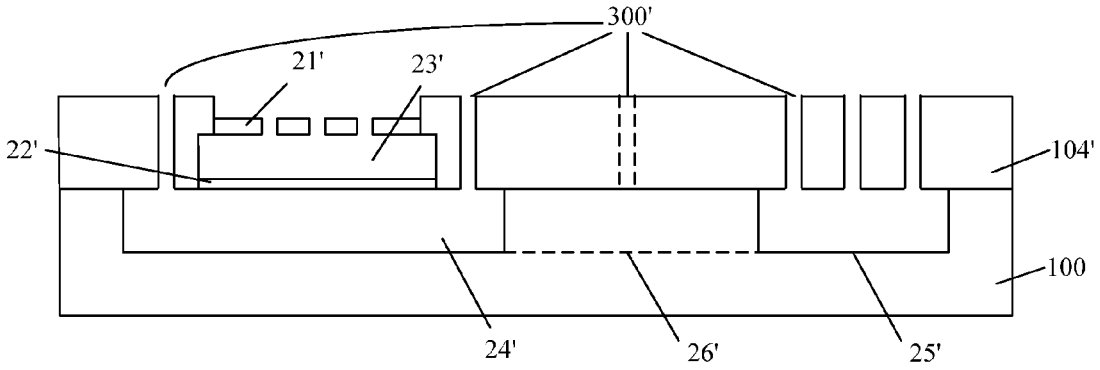
Figure 22A:
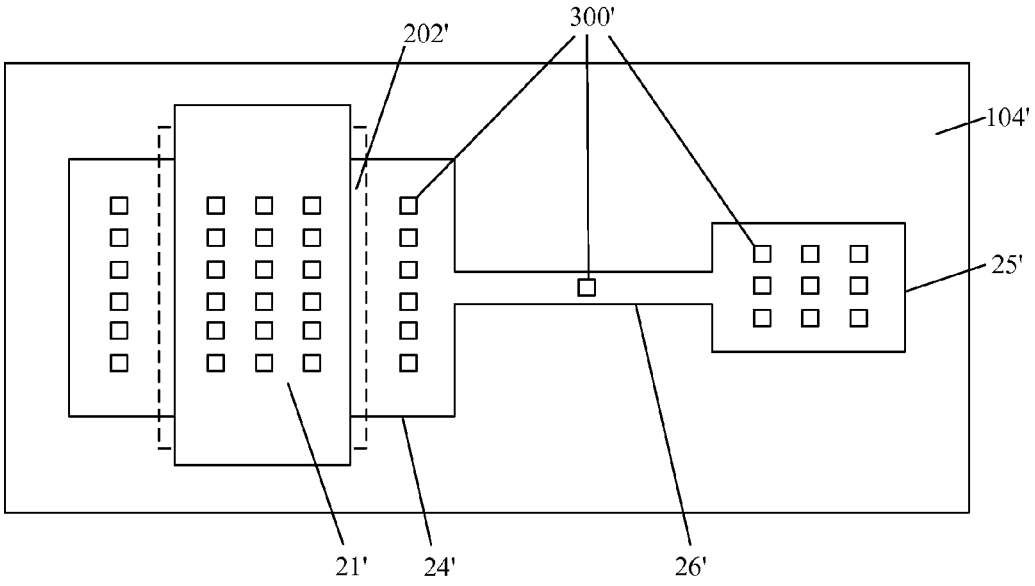

Referring to FIG. 22 and FIG. 22*a*, a remove material is fed into the isolation layer 104' and the electrode plate 21' through the through holes 300' and the air holes in the electrode plate 21' to remove the first sacrificial layer 201 and the second sacrificial layer 202'.

Because the first sacrificial layer 201 and the second sacrificial layer 202' include a compact material, e.g., amorphous carbon, which is formed using a CVD method, the remove material may include oxide. In some embodiments, a process like an ash process may be used to remove the first sacrificial layer 201 and the second sacrificial layer 202'. Specifically, in a plasma chamber containing $O_2$, the first sacrificial layer 201 and the second sacrificial layer 202' including amorphous carbon may be oxidized to form gaseous oxide, like $CO_2$ or CO. A heating temperature may be from 100° C. to 350° C. At this temperature, the amorphous carbon is oxidized softly and slowly to form gaseous $CO_2$ or CO, which is exhausted via the through holes 300' and the air holes in the electrode plate 21'. In this way, the first sacrificial layer 201 and the second sacrificial layer 202' may be removed completely without damage to the other parts of the MEMS microphone. After the first sacrificial layer 201 and the second sacrificial layer 202' are removed, the first groove 101 under the diaphragm 22' constitutes the back cavity 24', the room where the second sacrificial layer 202' locates between the electrode plate 21' and the diaphragm 22' constitutes the air gap cavity 23', and the connecting groove 103 and the second groove 102 respectively constitute the air groove 26' and the second cavity 25'.

Figure 23:
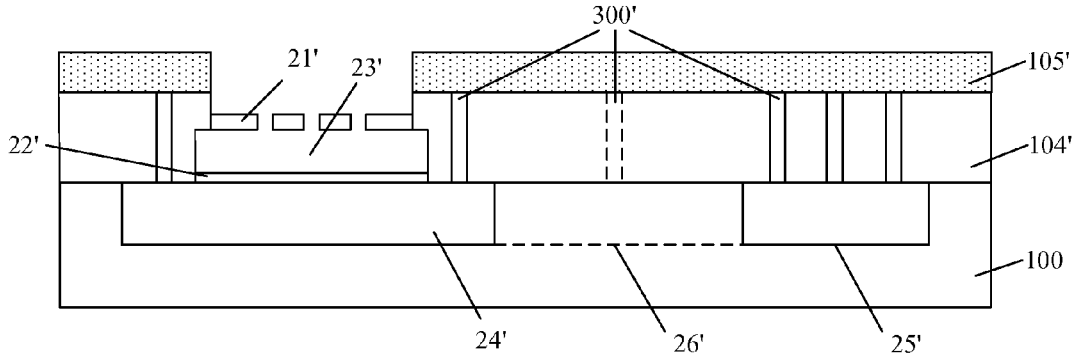
Figure 23A:
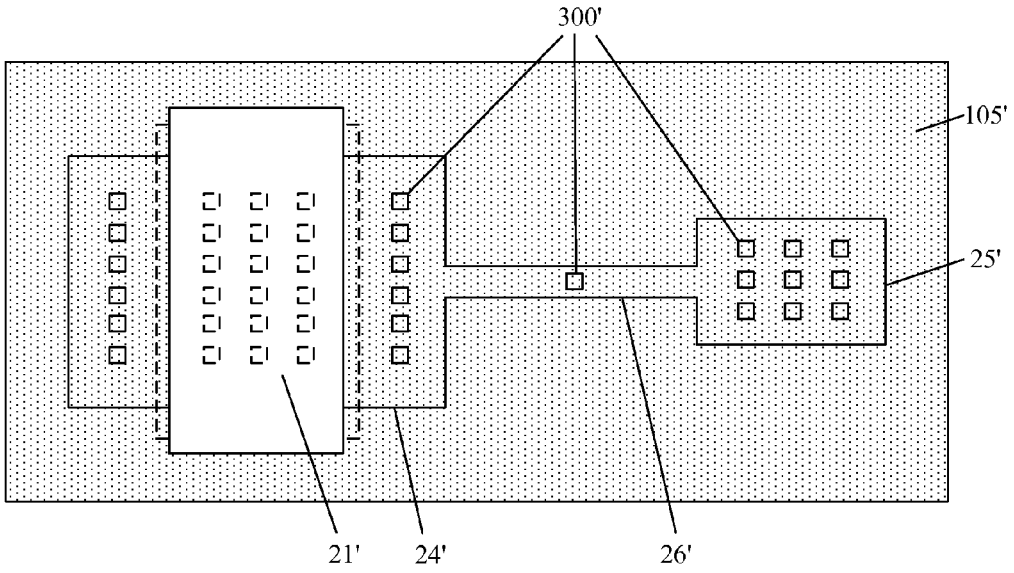

Referring to FIG. 23 and FIG. 23*a*, a cover layer 105' is formed on the isolation layer 104'. The cover layer 105' may be formed using a CVD method. Similar to the first embodiment, the cover layer 105' is easy to seal the through holes 300' without penetrating to cavities in the isolation layer 104'. In order to simplify processes, the cover layer 105' may use the same material as the isolation layer 104'.

Figure 24:
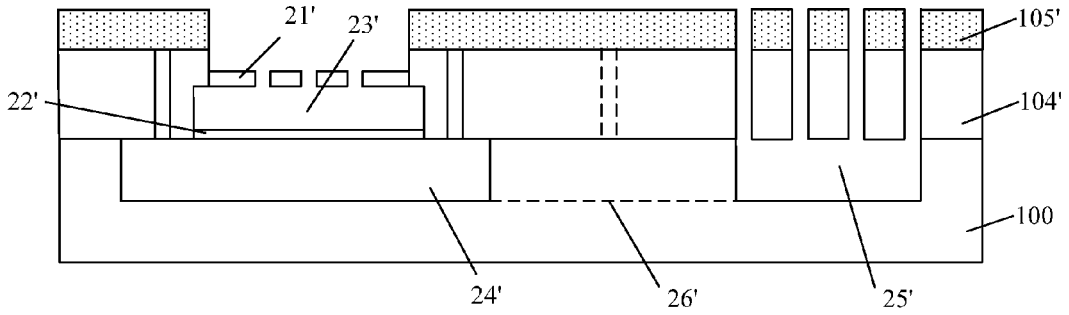
Figure 24A:
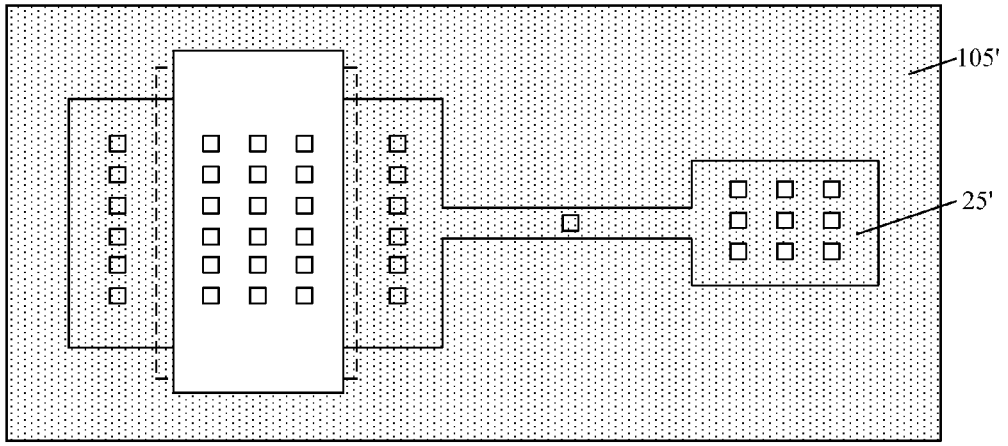

Referring to FIG. 24 and FIG. 24*a*, the cover layer 105' and the isolation layer 104' are etched successively to form a connecting hole and to expose the second cavity 25'.

Optionally, the cover layer 105' may be formed to expose the second groove 102, such that the second groove 102 may be exposed to the external environment via the through holes 300' formed in the isolation layer 104'.

The MEMS microphone shown in FIG. 15 is manufactured using the above processes. The isolation layer 104' and the cover layer 105' serve as an isolation structure for fixing and protecting the electrode plate 21' and the diaphragm 22'. As the MEMS microphone is manufactured based on a semiconductor substrate, a metal interconnection may be formed in the semiconductor substrate or in the isolation structure, such that the electrode plate 21' and the diaphragm 22' may be connected to an external electrode. The metal interconnection process is known in the art, and will not be described in detail herein.

Although the present disclosure has been disclosed above with reference to preferred embodiments thereof, it should be understood that the disclosure is presented by way of example only, and not limitation. Those skilled in the art can modify and vary the embodiments without departing from the spirit and scope of the present disclosure.

What is claimed is:

1. A method for manufacturing a micro-electro-mechanical microphone, comprising:

providing a semiconductor substrate;

forming a first groove, a second groove and a connecting groove on a surface of the semiconductor substrate, the connecting groove joining the first groove and the second groove;

forming a first sacrificial layer in the first groove;

forming an electrode plate with air holes on the first sacrificial layer, the electrode plate stretching across the first groove and extending to the surface of the semiconductor substrate;

forming a second sacrificial layer on the electrode plate, the second sacrificial layer connecting to the first sacrificial layer;

forming a diaphragm on the second sacrificial layer;

forming an isolation structure; and removing the first sacrificial layer and the second sacrificial layer.

2. The method according to claim 1, wherein forming an isolation structure and removing the first sacrificial layer and the second sacrificial layer comprises:

forming an isolation layer on the first sacrificial layer, the second sacrificial layer, the diaphragm and the semiconductor substrate;

forming a plurality of through holes by etching the isolation layer, the plurality of through holes exposing the first sacrificial layer;

removing the first sacrificial layer and the second sacrificial layer through the plurality of through holes;

forming a cover layer on the isolation layer, the cover layer sealing the plurality of through holes; and etching the cover layer and the isolation layer successively to form a third groove which exposes the diaphragm, where the isolation layer and cover layer serve as the isolation structure for fixing the electrode plate and the diaphragm.

3. The method according to claim 2, wherein the first sacrificial layer and the second sacrificial layer comprise amorphous carbon.

4. The method according to claim 3, wherein removing the first sacrificial layer and the second sacrificial layer further comprising, in a plasma chamber containing $O_2$, oxidizing the first sacrificial layer and the second sacrificial layer comprising the amorphous carbon to generate gaseous $CO_2$ or CO.

5. The method according to claim 4, wherein the oxidizing process comprises an oxidizing temperature from 100° C. to 350° C.

6. The method according to claim 2, wherein a Chemical Vapor Deposition (CVD) process is employed to form the first sacrificial layer in the first groove and to form the second sacrificial layer on the electrode plate.

7. The method according to claim 6, wherein the CVD process comprises a temperature ranging from 350° C. to 500° C. and a mixed gas comprising $C_3H_6$ and He.

8. The method according to claim 2, further comprising forming the first sacrificial layer in the connecting groove and the second groove.

9. The method according to claim 8, further comprising forming the isolation layer covering the connecting groove and the second groove.

10. The method according to claim 9, further comprising forming the through holes in the connecting groove and the second groove.

11. The method according to claim 10, further comprising etching the cover layer and the isolation layer successively to expose the second groove after the cover layer is formed on the isolation layer.

12. The method according to claim 10, further comprising forming the cover layer on the isolation layer except the location where the second groove is.

13. The method according to claim 1, wherein the first groove has a depth ranging from 0.5 μm to 50 μm, and the second sacrificial layer has a thickness ranging from 0.2 μm to 20 μm.

* * * * *

UNITED STATES PATENT AND TRADEMARK OFFICE

CERTIFICATE OF CORRECTION

PATENT NO. : 8,955,212 B2
APPLICATION NO. : 13/810698
DATED : February 17, 2015
INVENTOR(S) : Jianhong Mao et al.

It is certified that error appears in the above-identified patent and that said Letters Patent is hereby corrected as shown below:

IN THE DRAWINGS

Figure 1:
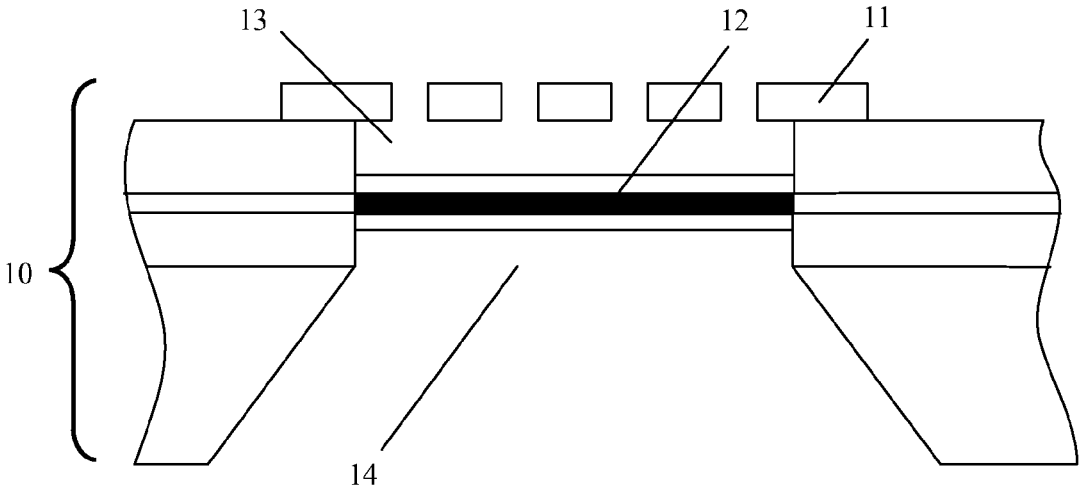
Fig.1 (prior art)
FIG. 1 illustrates a schematic sectional view of a conventional MEMS microphone.
Figure 2:
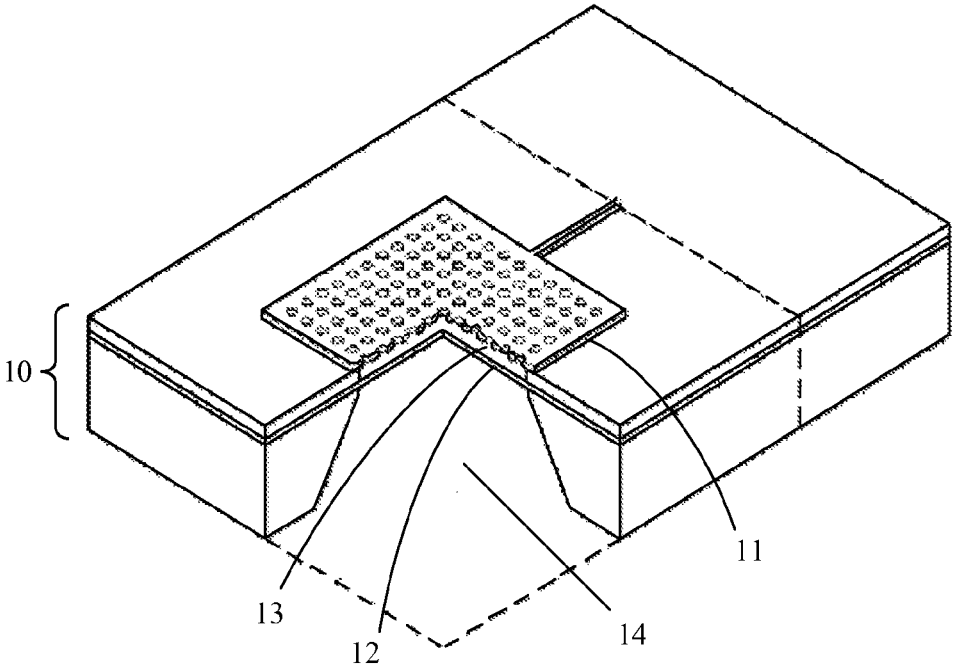
FIG. 2 illustrates a schematic 3D view of the MEMS microphone shown in FIG. 1.
Figure 2:
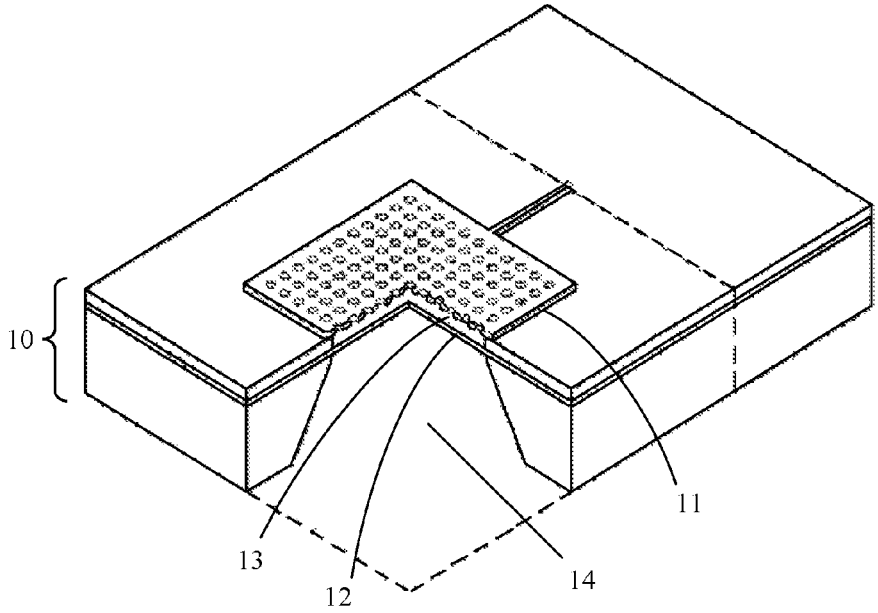
Fig. 2 (prior art)

Remove Fig. 2 on page 1 of 23

Signed and Sealed this
Twenty-third Day of February, 2016

Michelle K. Lee

Michelle K. Lee
*Director of the United States Patent and Trademark Office*